US010670988B2

(12) United States Patent
Fujii et al.

(10) Patent No.: US 10,670,988 B2
(45) Date of Patent: Jun. 2, 2020

(54) DEVELOPER CONTAINER, IMAGE FORMING UNIT, AND IMAGE FORMING APPARATUS

(71) Applicant: Oki Data Corporation, Tokyo (JP)

(72) Inventors: Masashi Fujii, Tokyo (JP); Junichi Ushikubo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/287,481

(22) Filed: Feb. 27, 2019

(65) Prior Publication Data

US 2019/0294078 A1 Sep. 26, 2019

(30) Foreign Application Priority Data

Mar. 23, 2018 (JP) ..... 2018-056717

(51) Int. Cl.
*G03G 15/08* (2006.01)
*G03G 21/16* (2006.01)

(52) U.S. Cl.
CPC ..... *G03G 15/0875* (2013.01); *G03G 15/0886* (2013.01); *G03G 15/0898* (2013.01); *G03G 21/1647* (2013.01)

(58) Field of Classification Search
CPC ..... G03G 15/0875; G03G 15/0865; G03G 15/0886; G03G 21/1647; G03G 2215/068; G03G 2215/0692
See application file for complete search history.

(56) References Cited

U.S. PATENT DOCUMENTS 5,325,162 A * 6/1994 Kroll ..... G03G 15/0126 222/DIG. 1
6,014,536 A * 1/2000 Ban ..... G03G 15/0855 399/258
6,181,898 B1 * 1/2001 Sato ..... G03G 21/1814 399/103
2017/0329277 A1 * 11/2017 Ushikubo ..... G03G 21/1647

FOREIGN PATENT DOCUMENTS

JP 2006113146 A 4/2006
JP 2009226603 A 10/2009
JP 2017-203940 A 11/2017

* cited by examiner

*Primary Examiner* — Sandra Brase
(74) *Attorney, Agent, or Firm* — Panitch Schwarze Belisario & Nadel LLP

(57) ABSTRACT

A developer container includes: a body in which a plurality of developer chambers that store developer are arranged, each developer chamber having an opening; and a plurality of covers that seal the openings of the plurality of developer chambers, the plurality of covers being separately provided to correspond to the openings of the plurality of developer chambers.

15 Claims, 23 Drawing Sheets

(RELATED ART)

(RELATED ART)

(RELATED ART)

DEVELOPER CONTAINER, IMAGE FORMING UNIT, AND IMAGE FORMING APPARATUS

BACKGROUND OF THE INVENTION

1. Field of the Invention

The present invention relates to a developer container that stores developer an image forming unit, and an image forming apparatus.

2. Description of the Related Art

A conventional developer container includes multiple developer chambers that are filled with developers of different colors and closed by a single cover (see e.g., Japanese Patent Application Publication. No. 2017-203940).

However, in the conventional technique, since multiple developer chambers are closed by a single cover, when the developer chambers are filled with developers of different colors, it is not possible to check for developer leakage from each developer chamber. Thus, mixture of developers of different colors in different developer chambers may occur, degrading image quality.

SUMMARY OF THE INVENTION

An object of an aspect of the present invention is to make it possible to easily check for developer leakage from developer chambers.

According to an aspect of the present invention, there is provided a developer container including: a body in which a plurality of developer chambers that store developer are arranged, each developer chamber having an opening; and a plurality of covers that seal the openings of the plurality of developer chambers, the plurality of covers being separately provided to correspond to the openings of the plurality of developer chambers.

DETAILED DESCRIPTION OF THE INVENTION

A developer container, an image forming unit, and an image forming apparatus according to an embodiment of the present invention will now be described with reference to the drawings.

Figure 2:
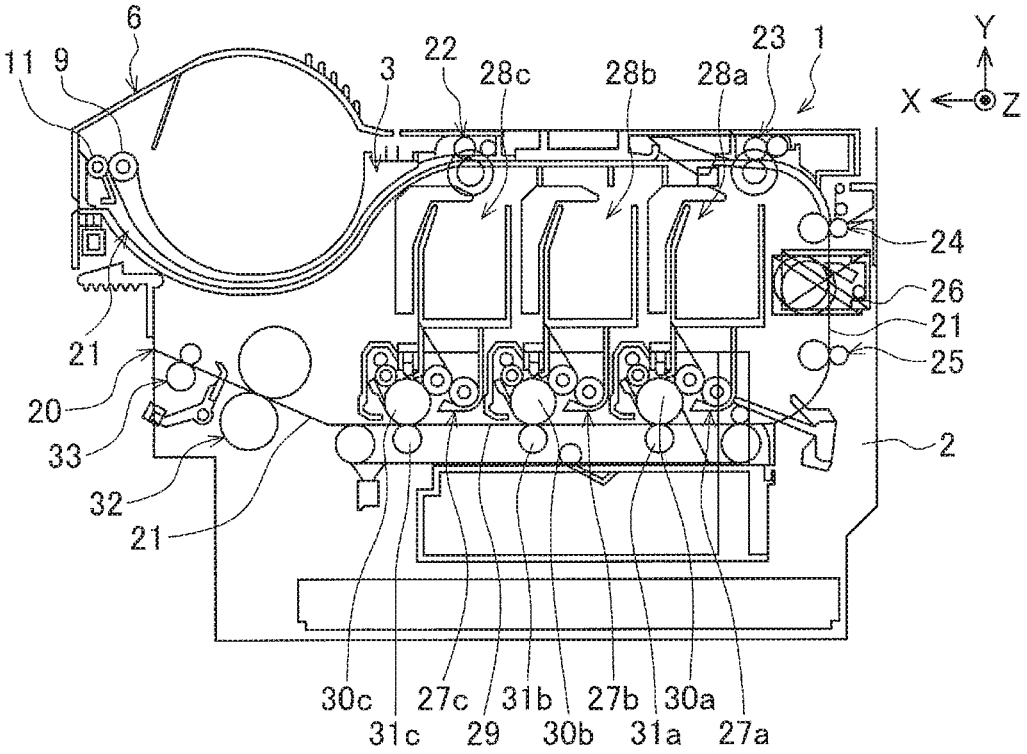
FIG. 2 is a side sectional view schematically illustrating a configuration of an image forming apparatus of the embodiment.

FIG. 2 is a side sectional view schematically illustrating a configuration of an image forming apparatus 1 according to an embodiment.

In FIG. 2, the image forming apparatus 1 is, for example, a roll paper printer with an image forming unit using an electrophotographic method, and includes a substantially box-shaped housing 2. It is assumed that a surface of the housing 2 on the left side of the drawing sheet is a front surface, a surface of the housing 2 on the right side of the drawing sheet is a back surface, a direction (indicated by arrow X in the drawing) from the back surface to the front surface of the housing 2 is the forward direction, a direction from the front surface to the back surface is the backward direction, a direction (indicated by arrow Y in the drawing) from the lower side to the upper side of the housing 2 is the upward direction, a direction from the upper side to the lower side is the downward direction, a direction of the housing 2 from the front side to the back side of the drawing sheet is the leftward direction, and a direction (indicated by arrow 2 in the drawing) of the housing 2 from the back side to the front side of the drawing sheet is the rightward direction.

A paper roll holder 3 that holds a cylindrical paper roll is disposed on the front side of an upper portion of the housing 2.

A cover 6 that covers the paper roll holder 3 is attached to the front side of the upper portion of the housing 2.

The image forming apparatus 1 is configured so that the cylindrical paper roll is stored in a cylindrical space consisting of a storage space of the paper roll holder 3 and an inner space of the cover 6 closed.

The paper roll holder 3 is provided with a holder side conveying roller 9, at an upper portion of a front end of the storage space. The cover 6 is provided with a cover side conveying roller 11. The cover side conveying roller 11 is configured so that when the cover 6 is closed, the cover side conveying roller 11 abuts the holder side conveying roller 9 and can convey paper (or a paper sheet) from the paper roll while nipping the paper.

A conveying path 21 is provided in the housing 2 of the image forming apparatus 1. The conveying path 21 extends from a front end of the paper roll holder 3 to a back end of the paper roll holder 3 along the lower side of the paper roll holder 3 and further extends through pairs of conveying rollers 22, 23, 24, 25, and 33 to a paper outlet 20.

The conveying path 21 is a path for conveying the paper from the paper roll stored in the paper roll holder 3 to the paper outlet 20, with the paper roll holder 3 side as the upstream side and the paper outlet 20 side as the downstream side.

The pairs of conveying rollers 72, 23, 24, 25, and 33 are pairs of rollers that nip and convey the paper from the paper roll. The pairs of conveying rollers 22, 23, 24, 25, and 33 are arranged in this order from the upstream side of the conveying path 21.

A housing side cutter 26 that cuts the paper is disposed between the pairs of conveying rollers 24 and 25.

Image forming portions 27*a*, 27*b*, and 27*c* are arranged along the conveying path 21 between the pairs of conveying rollers 25 and 33. The image forming portions 27*a*, 27*b*, and 27*c* may be referred to simply as the image forming portions 27.

The image forming portions 27*a*, 27*b*, and 27*c* form toner images as developer images of different colors (e.g., three colors). The image forming portions 27*a*, 27*b*, and 27*c* are arranged in this order from the upstream side of the conveying path 21. The image forming portions 27*a*, 27*b*, and 27*c* are attached with toner storing portions 28*a*, 28*b*, and 28*c* that store their respective toners.

A transfer belt 29 and transfer rollers 31*a*, 32*b*, and 31*c* are disposed below the image forming portions 27*a*, 27*b*, and 27*c*. The transfer belt 29 is annular and extends along the conveying path 21 in the front-back direction.

The transfer rollers 31*a*, 31*b*, and 31*c* are arranged to respectively face photosensitive drums 30*a*, 30*b*, and 30*c* of the image forming portions 27*a*, 27*b*, and 27*c* with the transfer belt 23 therebetween.

A fixing unit 32 is disposed downstream of the transfer belt 29 in the conveying path 21. The pair of conveying rollers 33 is disposed downstream of the fixing unit 32 and near the paper outlet 20.

Figure 1:
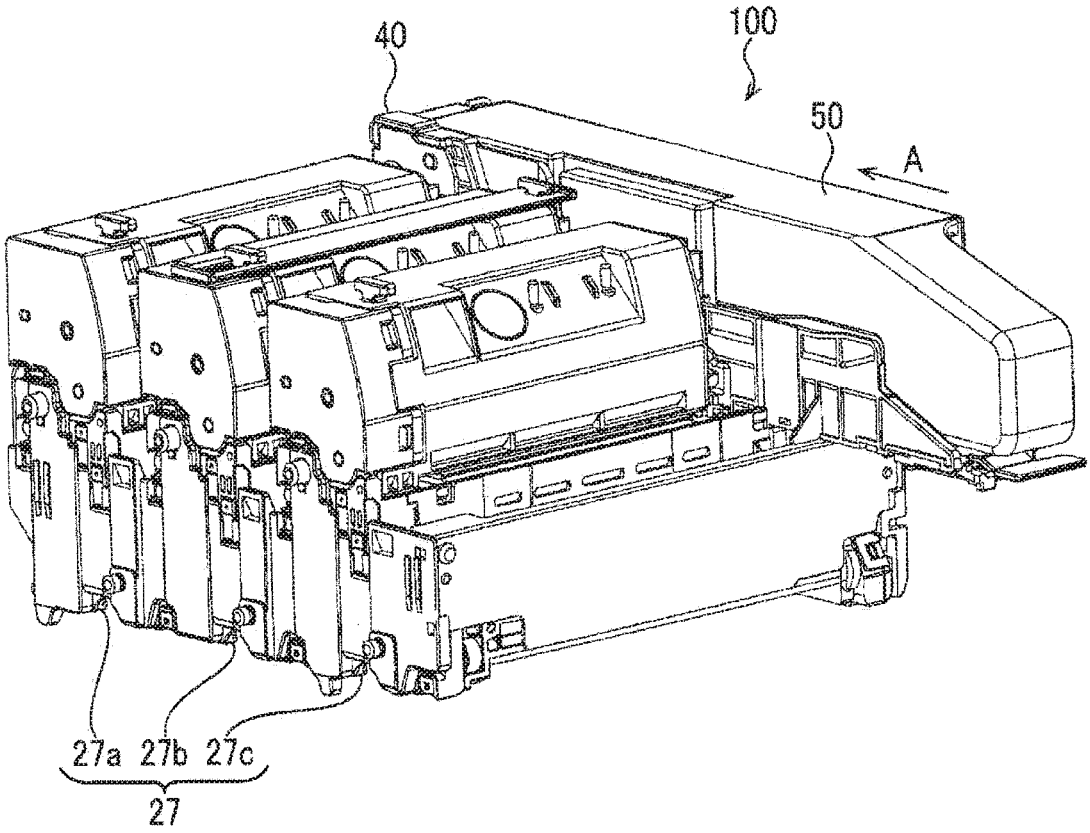
FIG. 1 is an external perspective view of an image forming unit of an embodiment.

FIG. 1 is an external perspective view of an image forming unit 100 of the embodiment.

In FIG. 1, the image forming unit 100 includes the image forming portions 27, a stage 40, and a toner cartridge 30.

The image forming portions 27 form toner images as developer images using the electrophotographic method. The image forming portions 27 include the photosensitive drums 30*a*, 30*b*, and 30*c* (illustrated in FIG. 2) serving as rotatable image carriers, charging units that uniformly charge surfaces of the photosensitive drums, exposure units that selectively illuminate the charged surfaces of the photosensitive drums with light to form electrostatic latent images, and developing units that supply toner as developer to the electrostatic latent images formed on the photosensitive drums to form toner images.

In the image forming portions 27 of this embodiment, for example, the image forming portion 27*a* forms a yellow toner image, the image forming portion 27*b* forms a magenta toner image, and the image forming portion 27*c* forms a cyan toner image. The image forming portions 27*a*, 27*b*, and 27*c* are arranged in this order in the medium conveying direction.

The stage 40, serving as a mount portion, is disposed on a side of the image forming portions 27 in a direction perpendicular to the medium conveying direction (on the right side of the image forming apparatus 1 illustrated in FIG. 2). The stage 40 is configured so that the toner cartridge 50 is detachably attached to the stage 40.

The toner cartridge 50, serving as a developer container, stores toners of the different colors, and is configured to be detachably attached to the stage 40. When the toner in the image forming portions 27*a*, 27*b*, and 27*c* has run short, by removing the toner cartridge 50 attached to the stage 40 and inserting a new toner cartridge 50 storing the toners of the different colors into the stage 40 in the direction indicated by arrow A in the drawing to attach the toner cartridge 50 to the stage 40, it is possible to supply the image forming portions 27*a*, 27*b*, and 27*c* with the respective toners of different colors.

Figure 3:
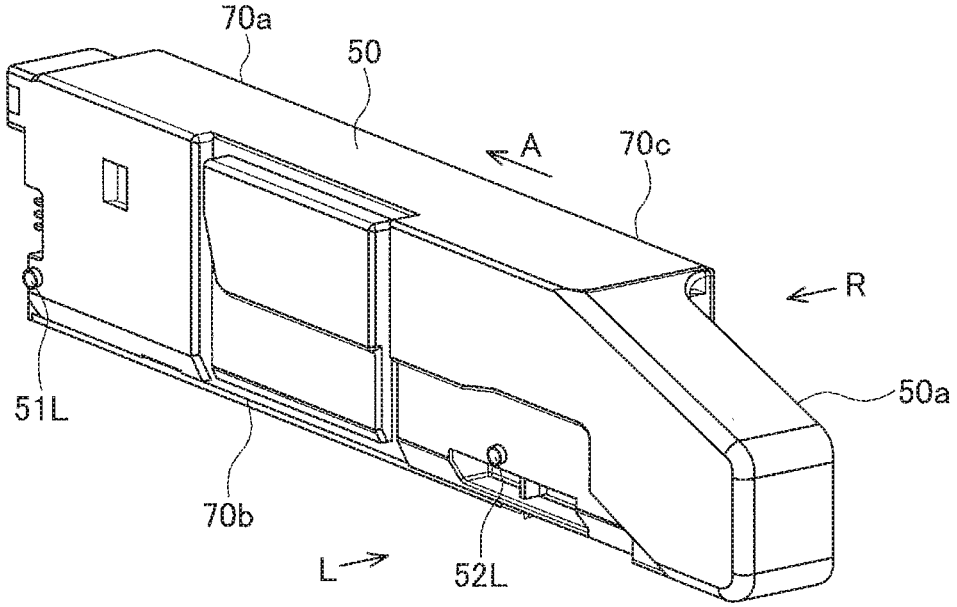
FIG. 3 is an external perspective view of a toner cartridge of the embodiment.
Figure 4:
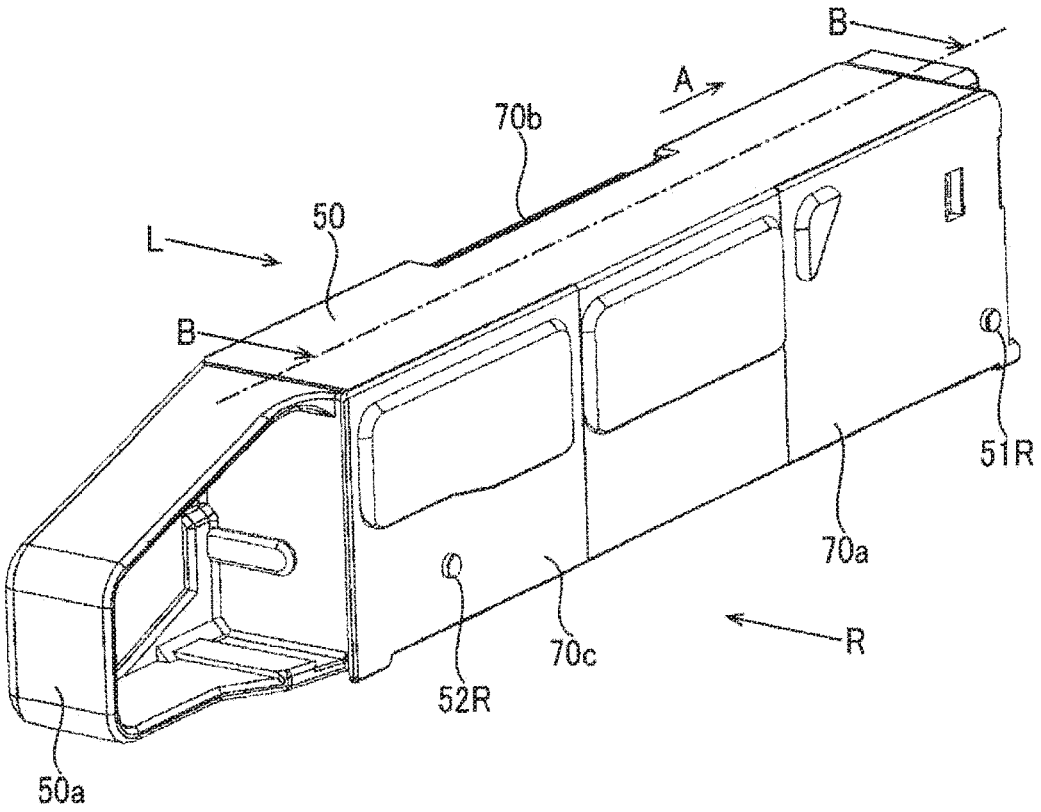
FIG. 4 is another external perspective view of the toner cartridge of the embodiment.

FIGS. 3 and 4 are external perspective views of the toner cartridge of the embodiment.

In FIGS. 3 and 4, the toner cartridge 50 has a left side surface on which posts 51L and 52L as projections are formed, and a right side surface on which posts 51R and 52R as projections are formed, as viewed in the direction indicated by arrow A in the drawings, in which the toner cartridge 50 is attached to the stage 40 illustrated in FIG. 1. The posts 51L, 52L, 51R, and 52R are substantially cylindrical. The posts 51L and 51R are formed on the front side of the toner cartridge 50 in the attachment direction indicated by arrow A in the drawings, and the posts 52L and 52R are formed on the back side of the toner cartridge 50 in the attachment direction indicated by arrow A in the drawings.

A handle 50*a* for an operator to handle the toner cartridge 50 is formed at a back end of the toner cartridge 50 in the attachment direction. While gripping the handle 50*a*, an operator can move the toner cartridge 50 relative to the stage 40 (see FIG. 1) in the attachment direction indicated by arrow A in the drawings to attach the toner cartridge 50 to the stage 40, and also can move the toner cartridge 50 relative to the stage 40 (see FIG. 1) in a direction opposite to the attachment direction indicated by arrow A in the drawings to remove the toner cartridge 50 from the stage 40.

Figure 5:
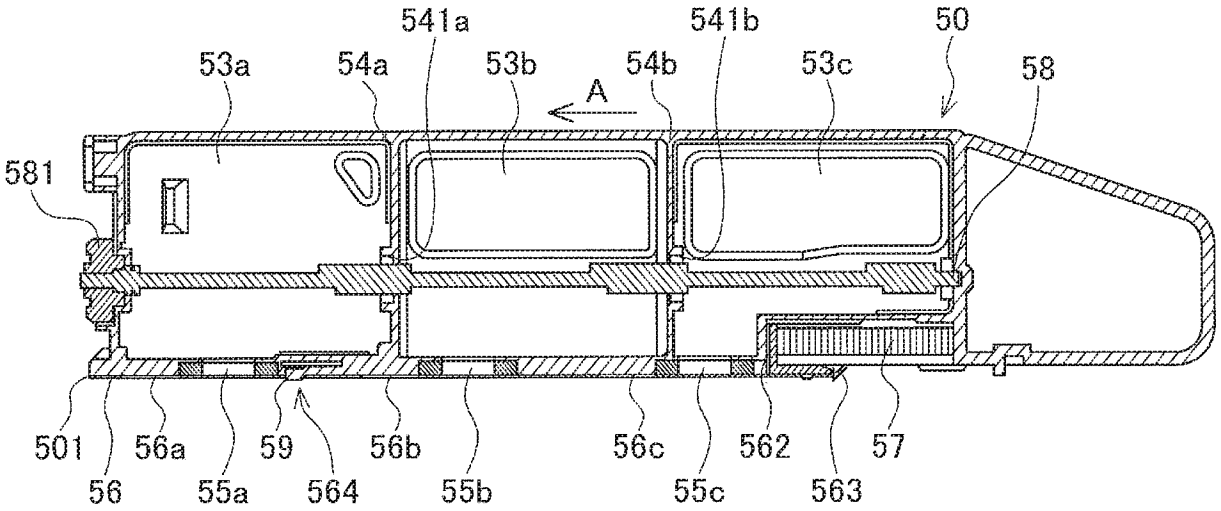
FIG. 5 is a sectional view of the toner cartridge of the embodiment.

FIG. 5 is a sectional view of the toner cartridge of the embodiment taken along line B-B in FIG. 4.

In FIG. 5, the toner cartridge 50 includes toner storing portions 53*a*, 53*b*, and 53*c*, partitions 54*a* and 54*b*, openings 55*a*, 55*b*, and 55*c*, a shutter 56, a spring 57, an agitating member 58, and a stopper 59.

The toner storing portions 53*a*, 53*b*, and 53*c*, serving as developer chambers, are chambers that store the toners of the different colors, and are multiple (three in this embodiment) developer chambers arranged in the attachment direction (in which the toner cartridge 50 is attached to the stage 40) indicated by arrow A in the drawing. In this embodiment, the toner storing portions 53*a*, 53*b*, and 53*c* are arranged in this order from the front side (or downstream side) in the attachment direction.

The toner storing portion 53*a* stores, for example, yellow toner, the toner storing portion 53*b* stores, for example, magenta toner, and the toner storing portion 53*c* stores, for example, cyan toner. The toner storing portions 53*a*, 53*b*, and 53*c* are arranged to correspond to the image forming portions 27*a*, 27*b*, and 27*c* illustrated in FIG. 1, respectively.

In this embodiment, the number of toner storing portions is three, but it may be two, four, or more. The number of toner storing portions may correspond to the number of image forming portions.

The partitions 54*a* and 54*b* are walls that separate the toner storing portions. The partition 54*a* is disposed between the toner storing portions 53*a* and 53*b*, and the partition 54*b* is disposed between the toner storing portions 53*b* and 53*c*.

The openings 55*a*, 55*b*, and 55*c*, serving as first openings, are holes formed in lower portions of the toner storing portions 53*a*, 53*b*, and 53*c* and allow the toner stored in the toner storing portions 53*a*, 53*b*, and 53*c* to pass therethrough, respectively. In the attachment direction indicated by arrow A in the drawing, the openings 55*a*, 55*b*, and 55*c* have predetermined lengths and are arranged at predetermined intervals. The openings 55*a*, 55*b*, and 55*c* have the same length in the attachment direction.

The shutter 56, serving as an opening-closing member, is disposed at a lower portion of the toner cartridge 50 slidably in the attachment direction indicated by arrow A in the drawing (and the direction opposite thereto). The shutter 56 is a plate-shaped member, that closes or opens the openings 55*a*, 55*b*, and 55*c*, and forms a bottom surface of the toner cartridge 50.

In the shutter 56, openings 56*a*, 56*b*, and 56*c* are formed. In the attachment direction indicated by arrow A in the drawing, the openings 56*a*, 56*b*, and 56*c* have the same length as the openings 55*a*, 55*b*, and 55*c*, and are arranged at the same intervals as the openings 55*a*, 55*b*, and 55*c*. Thus, when the openings 56*a*, 56*b*, and 56*c* of the shutter 56 are located at positions corresponding to or facing the openings 55*a*, 55*b*, and 55*c* of the toner storing portions, they open the openings 55*a*, 55*b*, and 55*c*; when the openings 56*a*, 56*b*, and 56*c* of the shutter 56 are located at positions that do not correspond to or face the openings 55*a*, 55*b*, and 55*c* of the toner storing portions, they closes the openings 55*a*, 55*b*, and 55*c*.

Further, in the shutter 56, an abutment portion 562 and an engaged portion 563 are formed. The abutment portion 562 abuts the spring 57. The engaged portion 563 engages with a projection 46 (see FIG. 9A) formed in the stage 40 illustrated in FIG. 1.

The spring 57, serving as an urging member, is an urging means that urges the shutter 56 in the attachment direction indicated by arrow A in the drawing. The shutter 56 urged by the spring 57 is stopped by abutting an abutment portion 501 disposed at a lower portion of the toner cartridge 50, and closes the openings 55*a*, 55*b*, and 55*c* of the toner storing portions. FIG. 5 illustrates a state where the shutter 56 is urged by the spring 57 of the toner cartridge 50 and closes the openings 55*a*, 55*b*, and 55*c* of the toner storing portions.

The agitating member 58 is a rotatable member extending in the attachment direction indicated by arrow A in the drawing, and is disposed to pass through the toner storing portions 53*a*, 53*b*, and 53*c*. A gear 581 is formed at a tip portion of the agitating member 58 in the attachment direction. Rotational drive from a drive source of the image forming apparatus 1 illustrated in FIG. 2 is transmitted to the gear 581, rotating the agitating member 58. The rotation of the agitating member 58 agitates the toner in the toner storing portions 53*a*, 53*b*, and 53*c* to prevent toner aggregation or the like.

A sealing member 541*a* is disposed between the partition 54*a* and the agitating member 58, and a sealing member 541*b* is disposed between the partition 54*b* and the agitating member 58. The sealing members 541*a* and 541*b* prevent toner leakage from the toner storing portions 53*a*, 53*b*, and 53*c*, and prevent mixture of the toners in the toner storing portions 53*a*, 53*b*, and 53*c*.

The stopper 59, serving as a locking member, has a projection formed at its tip. By engagement of the projection with a hole 564 formed in the shutter 56, the stopper 59 prevents or limits sliding of the shutter 56. The stopper 59 is supported, for example, in a cantilever manner such that the projection at the tip can move up and down. In this embodiment, the stopper 59 prevents or limits sliding of the shutter 56 to maintain the state where the shutter 56 closes (or opens) the openings 55*a*, 55*b*, and 55*c*. The stopper 59 may be omitted from the toner cartridge 50.

Figure 6:
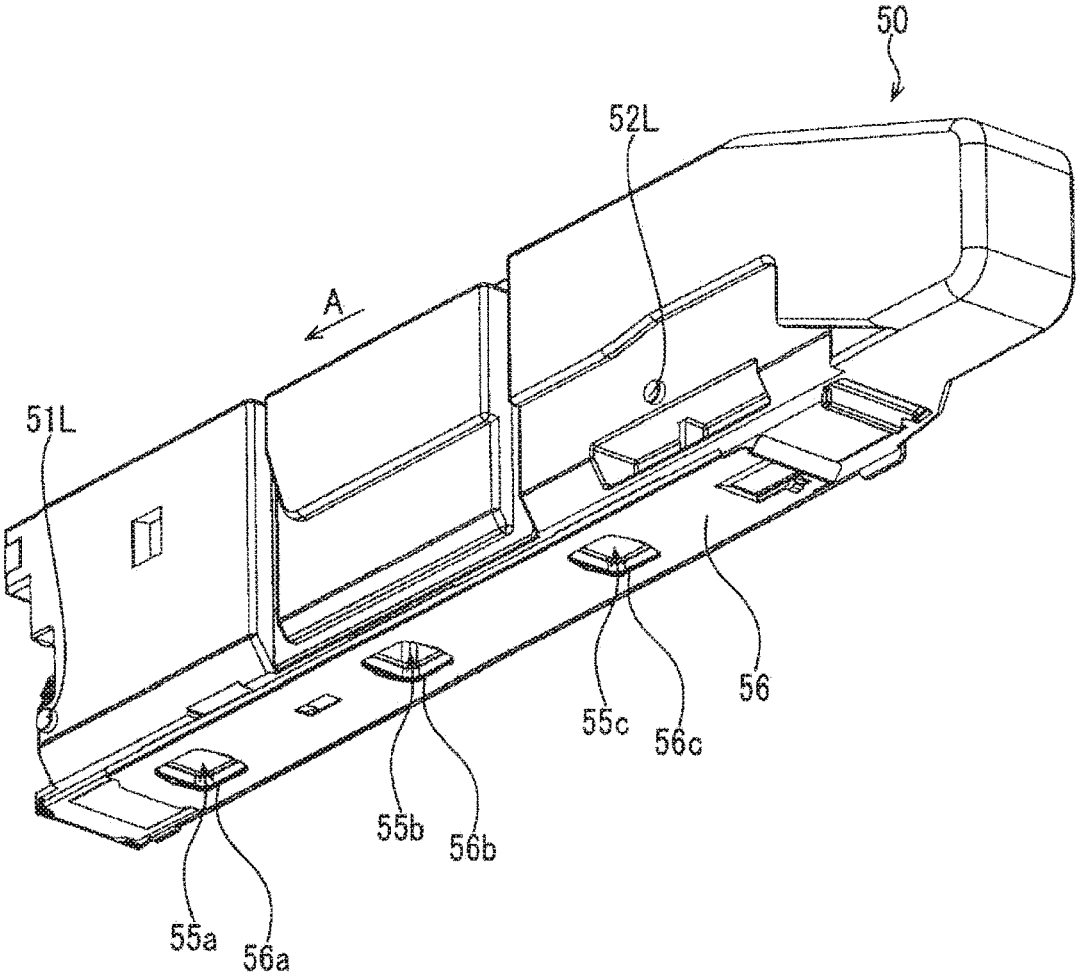
FIG. 6 is a perspective view of the toner cartridge of the embodiment.

FIG. 6 is a perspective view of the toner cartridge of the embodiment as viewed from the bottom side of the toner cartridge.

FIG. 6 illustrates a state where the shutter 56 of the toner cartridge 50 opens the openings 55*a*, 55*b*, and 55*c* of the toner storing portions.

As illustrated in FIG. 6, when the openings 56*a*, 56*b*, and 56*c* of the shutter 56 are located at positions corresponding to or facing the openings 55*a*, 55*b*, and 55*c* of the toner storing portions (specifically, the toner storing portions 53*a*, 53*b*, and 53*c* illustrated in FIG. 5), the openings 55*a*, 55*b*, and 55*c* are opened. Thus, the toner stored in the toner storing portions 53*a*, 53*b*, and 53*c* illustrated in FIG. 5 falls through the openings 56*a*, 56*b*, and 56*c* and the openings 55*a*, 55*c*, and 55*c*, respectively, and is supplied to the image forming portions 27*a*, 27*b*, and 27*c* illustrated in FIG. 1.

Figure 7:
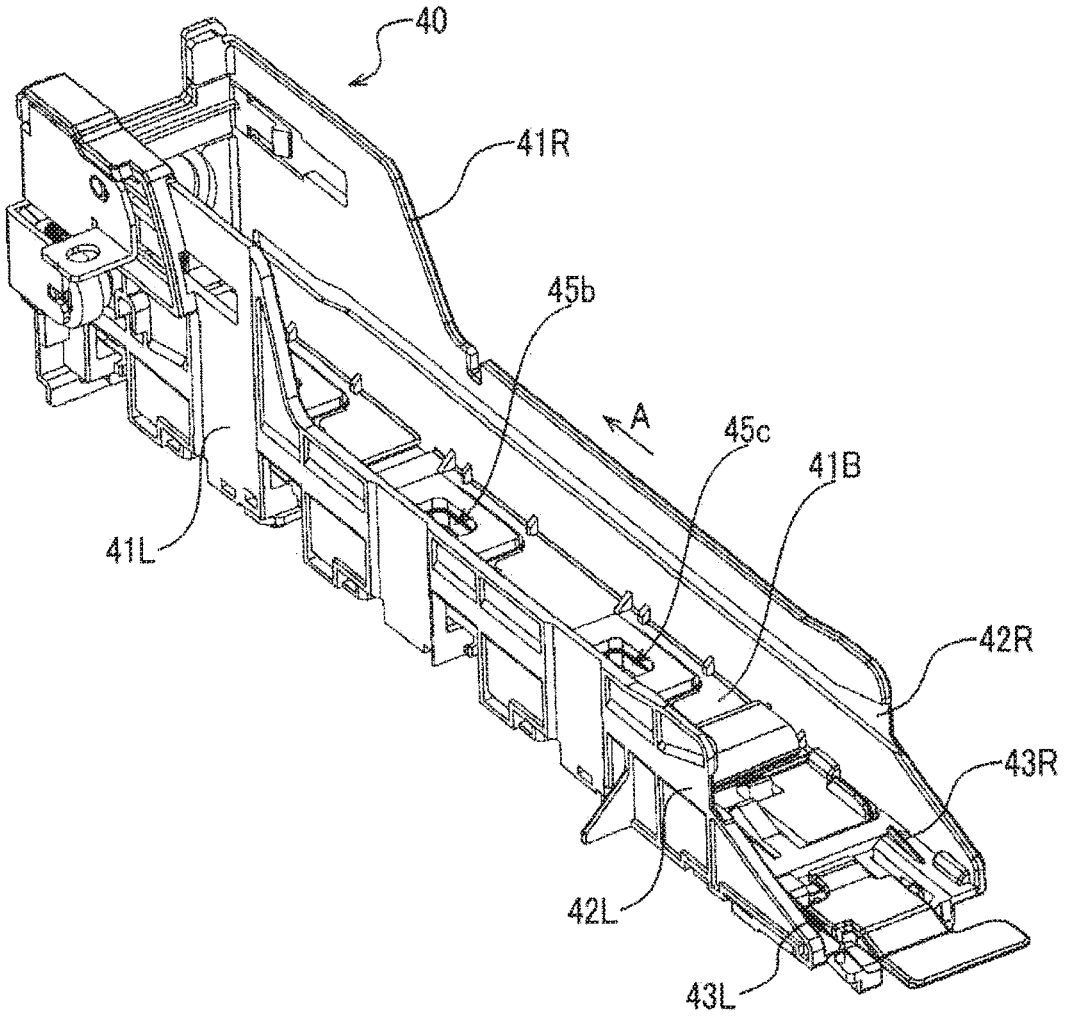
FIG. 7 is a perspective view of a stage of the embodiment.

FIG. 7 is a perspective view of the stage of the embodiment.

In FIG. 7, the stage 40 includes side walls 41L and 41R, a bottom plate 41B, rails 42L and 42R, and limiters 43L and 43R.

The side walls 41L and 41R are walls formed on both left and right sides of the stage 40 as viewed in the toner cartridge attachment direction indicated by arrow A in the drawing. The bottom plate 41B forms a bottom portion of the stage 40.

The rails 42L and 42R, serving as guide portions, are guides (or guide grooves) formed in inner sides of the side walls 41L and 41R to extend in the toner cartridge attachment direction indicated arrow A in the drawing. The rails 42L and 42R slidably guide the toner cartridge 50 with the posts 51L and 51R or/and the posts 52L and 52R, which are projections formed on both sides of the toner cartridge 50 illustrated in FIGS. 3 and 4 fitted in the rails 42L and 42R.

The limiters 43L and 43R are projection-shaped members having predetermined heights. The limiters 43L and 43R are formed on inner sides of the side walls 41L and 41R and on both left and right sides of the bottom plate 41B to extend in the toner cartridge attachment direction indicated by arrow A in the drawing. When the posts 51L and 51R of the toner cartridge 50 illustrated in FIGS. 3 and 4 are fitted in the rails 42L and 42R, the limiters 43L and 43R abut both sides of the bottom surface of the toner cartridge 50, thereby separating the bottom surface of the toner cartridge 50 from the bottom plate 41B to prevent toner adhering to the bottom surface of the toner cartridge 50 from adhering to the bottom plate 41B and prevent toner adhering to the bottom plate 41B from adhering to the bottom surface of the toner cartridge 50.

Figure 8:
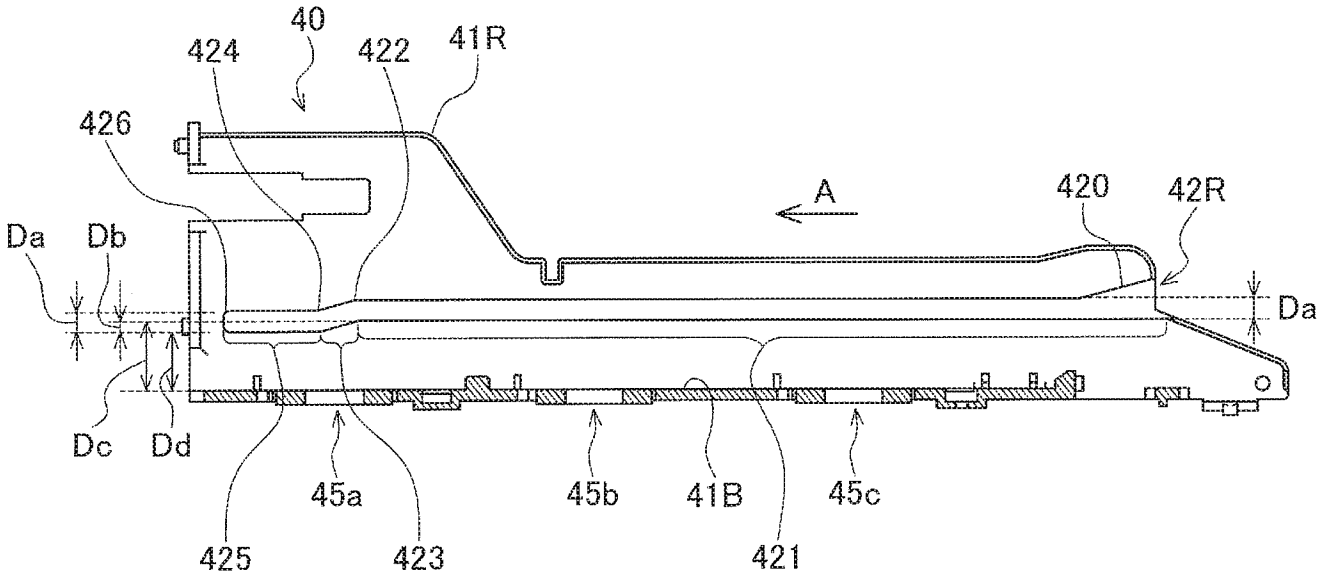
FIG. 8 is a view for explaining the stage and rails of the embodiment.

FIG. 8 is a view for explaining the stage and rails of the embodiment, and illustrates a side surface of the 42R illustrated in FIG. 7. The rail 42L has the same configuration as the rail 42R.

In FIG. 8, the stage 40 has openings 45*a*, 45*b*, and 45*c*.

The openings 45*a*, 45*b*, and 45*c*, serving as second openings, are holes formed in the bottom plate 41B, and are multiple holes formed to correspond to the openings 55*a*, 55*b*, and 55*c* of the toner cartridge 50 illustrated in FIG. 5. In the attachment direction indicated by arrow A in the drawing, the openings 45*a*, 45*b*, and 45*c* have the same length as the openings 55*a*, 55*b*, and 55*c* of the toner cartridge 50 illustrated in FIG. 5, and are arranged at the same intervals as the openings 55*a*, 55*b*, and 55*c* of the toner cartridge 50.

The openings 45*a*, 45*b*, and 45*c* correspond to and communicate with the image forming portions 27*a*, 27*b*, and 27*c* illustrated in FIG. 1, and can allow toner passing through the openings 55*a*, 55*b*, and 55*c* of the toner cartridge 50 to further pass therethrough and be supplied to the image forming portions 27*a*, 27*b*, and 27*c*, respectively.

The rail 42R has a first linear section 421, a first corner 422, a slope section 423, a second corner 424, and a second linear section 425.

The first linear section 421 is a linear section extending from an insertion inlet 420, which is a most upstream portion of the rail 42R in the toner cartridge attachment direction indicated by arrow A in the drawing, to the first corner 422. The first linear section 421 is formed substantially parallel to the bottom plate 41B (or bottom surface).

The first corner 422 is formed at the downstream end of the first linear section 421 in the toner cartridge attachment direction.

The slope section 423, serving as a connection, is formed downstream of the first corner 422 in the toner cartridge attachment direction. The slope section 423 is inclined at a predetermined angle in a direction such that it approaches the bottom plate 41B downstream in the toner cartridge attachment direction.

The second corner 424 is formed at the downstream end of the slope section 423 in the toner cartridge attachment direction.

The second linear section 425 is formed downstream of the second corner 424 in the toner cartridge attachment direction, and is a linear section extending from the second corner 424 to a terminal end 426, which is a most downstream portion of the rail 42R in the toner cartridge attachment direction. The second linear section 425 is formed substantially parallel to the bottom plate 41B (or bottom surface).

In this manner, the rail 42R has the first linear section 421 formed on the upstream side in the toner cartridge attachment direction, the second linear section 425 located downstream of the first linear section 421 in the toner cartridge attachment direction, and the slope section 423 connecting the downstream end of the first linear section 421 in the toner cartridge attachment direction and the upstream end of the second linear section 425 in the toner cartridge attachment direction.

A height (or width) of the rail 42R is Da, and is substantially equal to or slightly larger than diameters of the posts 51R and 52R which are substantially cylindrical, of the toner cartridge 50 illustrated in FIG. 4.

A difference in height between a lower surface of the first linear section 421 and a lower surface of the second linear section 425 is Db.

In this embodiment, the difference Db in height is one-half of the height Da; for example, the height Da is 4 mm and the height difference Db is 2 mm.

Thus, a distance Dc between the first linear section 421 and the bottom plate 41B (or bottom surface) is greater than a distance Dd between the second linear section 425 and the bottom plate 41B (or bottom surface).

Figure 9A:
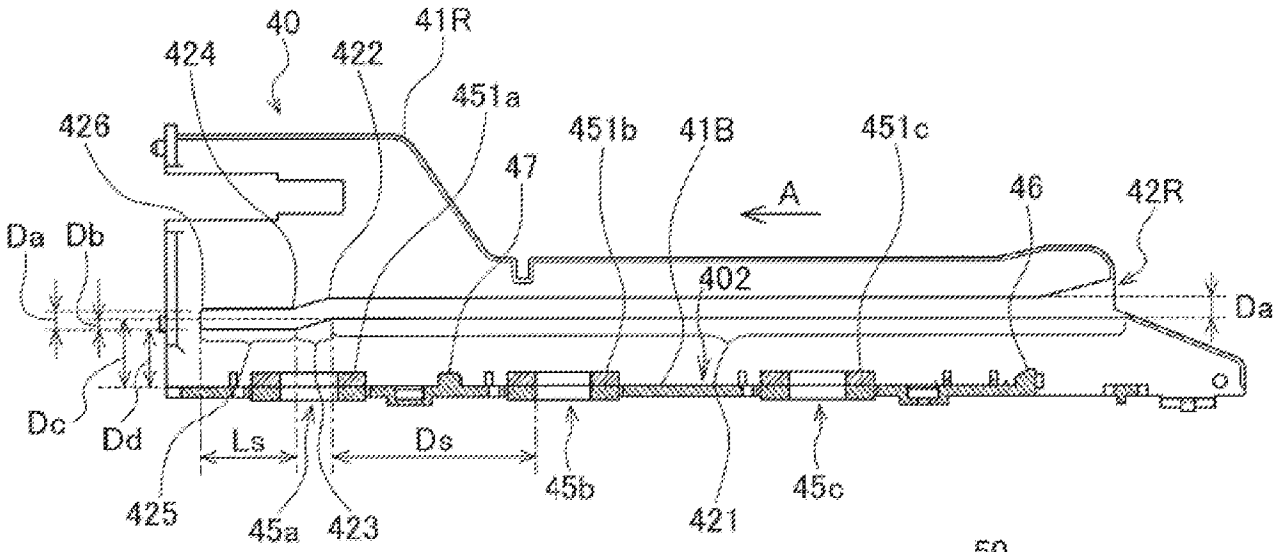
FIGS. 9A and 9B are explanatory views illustrating a positional relationship between the rails and posts in the embodiment.
Figure 9B:
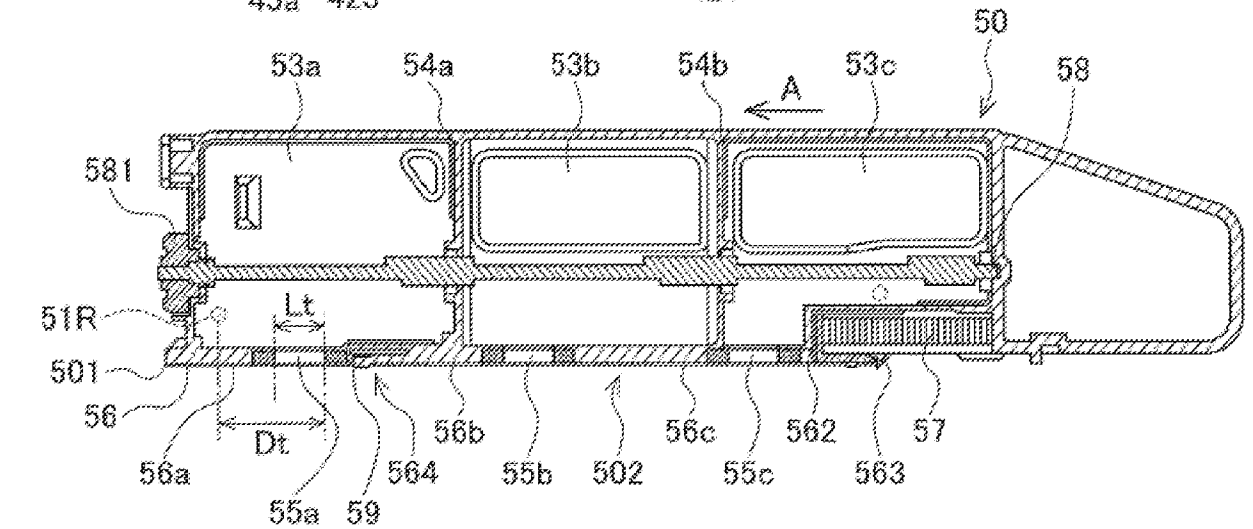

FIGS. 9A and 9B are explanatory views illustrating a positional relationship between the rails and the posts in the embodiment. FIG. 9A is a sectional view of the stage 40, and illustrates the rail 42R. FIG. 9B is a sectional view of the toner cartridge 50 taken along line B-B in FIG. 4.

As illustrated in FIG. 9A, in the toner cartridge attachment direction indicated by arrow A in the drawing, a distance between the first corner 422, which is the downstream end of the first linear section 421, of the rail 42R of the stage 40, and the downstream end of the opening 45*b*, which is the second opening from the most downstream side, is denoted by Ds.

As illustrated in FIG. 3B, in the toner cartridge attachment direction, a distance between a center of the post 51R of the toner cartridge 50 and the upstream end of the opening 55*a* is denoted by Dt. The post 51R is located downstream of the most downstream opening 55*a* in the toner cartridge attachment direction.

In this embodiment, the rail 42R, opening 45*b*, post 51R, and opening 55*a* are formed to satisfy at least the relationship of Ds>Dt.

This is to ensure that when the post SIR of the toner cartridge 50 has reached the first corner 422 after the toner cartridge 50 is slid in the attachment direction with the post SIR fitted in the rail 42R, the opening 55*a* of the toner cartridge 50 is located downstream of the opening 45*b* of the stage 40 in the attachment direction.

Thereby, when there is toner adhering to the toner cartridge 50 around the opening 55*a*, it is possible to prevent the toner from adhering to the opening 45*b* of the stage 40, thereby preventing mixture of toners of different colors.

As illustrated in FIG. 9A, in the toner cartridge attachment direction indicated by arrow a in the drawing, a length of the second linear section 425 (in this embodiment, a distance between a center of the post 51R and the second corner 424 when the post 51R of the toner cartridge 50 abuts the terminal end 426 of the rail 42R of the stage 40) is denoted by Ls.

As illustrated in FIG. 9B, in the toner cartridge attachment direction, a length of the opening 55*a* of the toner cartridge 50, i.e., a distance between the upstream end and the downstream end of the opening 55*a*, is denoted by Lt.

In this embodiment, the rail 42R and opening 55*a* are formed to satisfy at least the relationship of Ls>Lt.

This is to ensure that when the post 51R of the toner cartridge 50 has reached the terminal end 426 after the toner cartridge 50 is slid in the attachment direction with the post 52R fitted in the rail 42R, the opening 56*a* of the shutter 56 corresponds to or faces the opening 55*a* of the toner cartridge 50.

A reason why the length of the second linear section 425 is taken as the distance Ls is because the post 51R can have a pin shape with a small radius.

In this embodiment, as illustrated in FIG. 9A, projections 46 and 47, serving as engaging portions, are formed on the bottom plate 41B of the stage 40. When the post 51R of the toner cartridge 50 illustrated in FIG. 9B has reached the second corner 424, the projection 47 of the stage 40 abuts the projection at the tip of the stopper 59 of the toner cartridge 50, thereby releasing the engagement of the stopper 59 with the hole 564 of the shutter 56 and allowing the shutter 56 to slide relative to the toner cartridge 50. Further, when the post 51R of the toner cartridge 50 illustrated in FIG. 9B has reached the second corner 424, the engaged portion 563 of the shutter 56 of the toner cartridge 50 abuts and engages with the projection 46.

In this embodiment, as illustrated in FIG. 9A, sealing members 451*a*, 451*b*, and 451*c* that prevent toner leakage are provided on contact surfaces of the stage 40 around the openings 45*a*, 45*b*, and 45*c* that abut the toner cartridge 50.

The rail 42L of the stage 40 has the same configuration as the rail 42R.

In this manner, while guiding the toner cartridge 50 in the toner cartridge attachment direction indicated by arrow A in the drawings, the rails 42R and 42L cause a first surface (or the bottom surface) 502 formed by the shutter 56 of the toner cartridge 50 to approach and separate from a second surface (or upper surface) 402 of the bottom plate 41B of the stage 40 in which the openings 45*a*, 45*b*, and 45*c* are formed.

Figure 10:
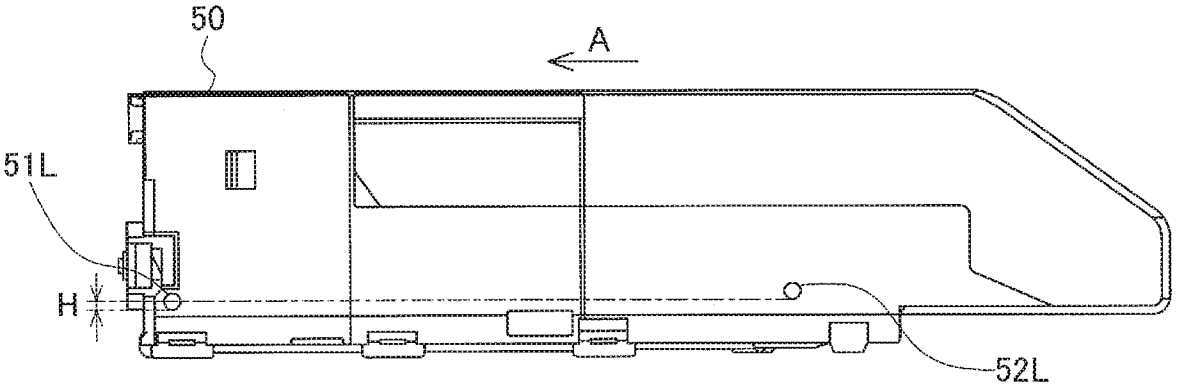
FIG. 10 is a side view of the toner cartridge of the embodiment.

FIG. 10 is a side view of the toner cartridge of the embodiment for explaining the posts of the toner cartridge.

In FIG. 10, a difference in height between the lower end of the post 51L and the lower end of the post 52L of the toner cartridge 50 is H. In this embodiment, the difference H is equal to the height difference Db between the lower surface of the first linear section 421 and the lower surface of the second linear section 425 of the stage 40 illustrated in FIG. 8, and is 2 mm.

This is to ensure that when the toner cartridge 50 has been attached to the stage 40 illustrated in FIG. 8, the bottom surface of the toner cartridge 50 is in close contact with the bottom plate 41B of the stage 40 with respect to the toner cartridge attachment direction indicated by arrow A in the drawing. Thus, it is possible to bring the openings of the toner cartridge 50 into close contact with the openings of the stage 40.

Figure 11:
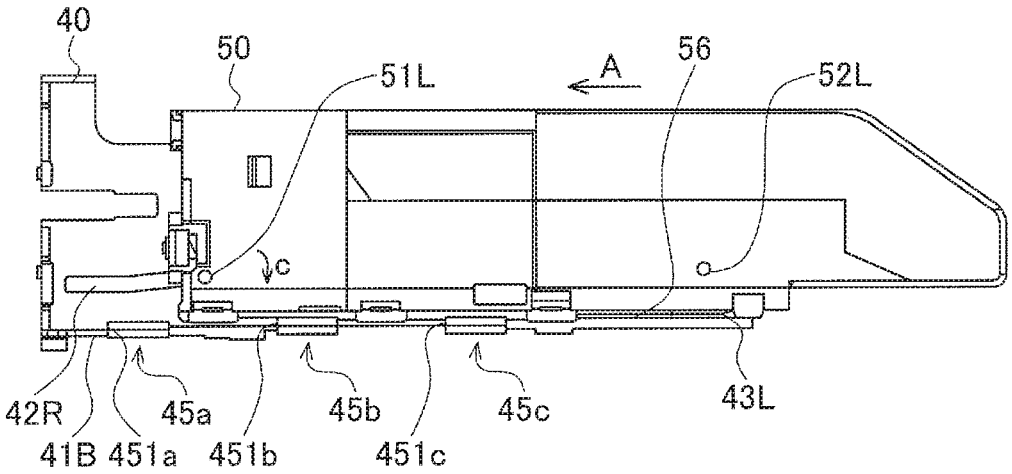
FIG. 11 is a view for explaining limiters of the stage of the embodiment.

FIG. 11 is a view for explaining the limiters of the stage of the embodiment. FIG. 11 is an explanatory view illustrating a state where the toner cartridge 50 is being attached to the stage 40 with the posts 51L and 51R of the toner cartridge 50 illustrated in FIGS. 3 and 4 fitted in the rails 42L and 42R of the stage 40 illustrated in FIG. 7.

As illustrated in FIG. 11, in a state where the toner cartridge 50 is incompletely attached to the stage 40, the toner cartridge 50 can rotate about the post 51R in the direction indicated by arrow C in the drawing.

At this time, the bottom surface of the toner cartridge 50 abuts the limiters 43L and 43R, limiting the rotation of the toner cartridge 50. Thus, a gap is formed between the shutter 56 of the toner cartridge 50 and the sealing members 451*a*, 451*b*, and 451*c* of the stage 40.

Figure 12:
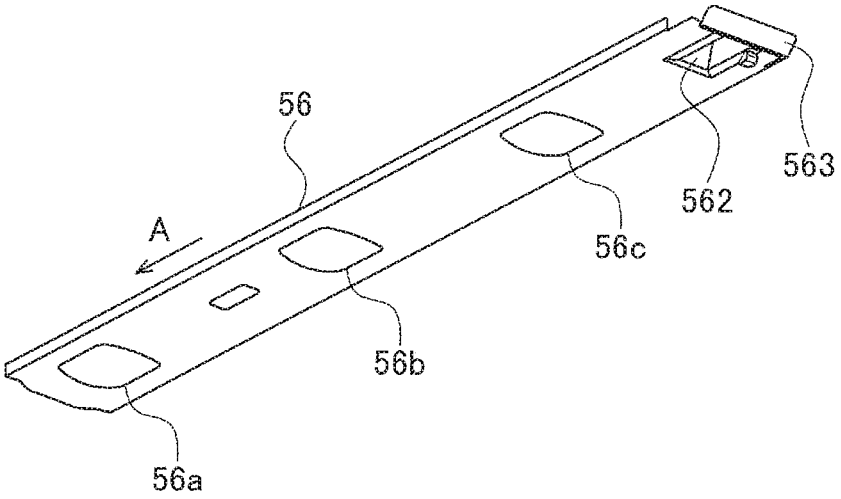
FIG. 12 is a perspective view of a shutter of the toner cartridge of the embodiment.

FIG. 12 is a perspective view of the shutter of the toner cartridge of the embodiment.

In FIG. 12, in the shutter 56, the openings 56*a*, 56*b*, and 56*c* are formed at regular intervals in this order from the downstream side in the toner cartridge attachment direction indicated by arrow A in the drawing so that they correspond to the openings 55*a*, 55*b*, and 55*c* of the toner cartridge 50 illustrated in FIG. 6. Thus, the shutter 56 can simultaneously open and close the openings 55*a*, 55*b*, and 55*c* of the toner cartridge 50 by sliding relative to the toner cartridge 50.

The engaged portion 563, which engages with the projection 46 of the stage 40, is formed at a back end of the shutter 56 in the toner cartridge attachment direction. The engaged portion 563 is formed to project downward from the bottom surface of the shutter 56.

Figure 13A:
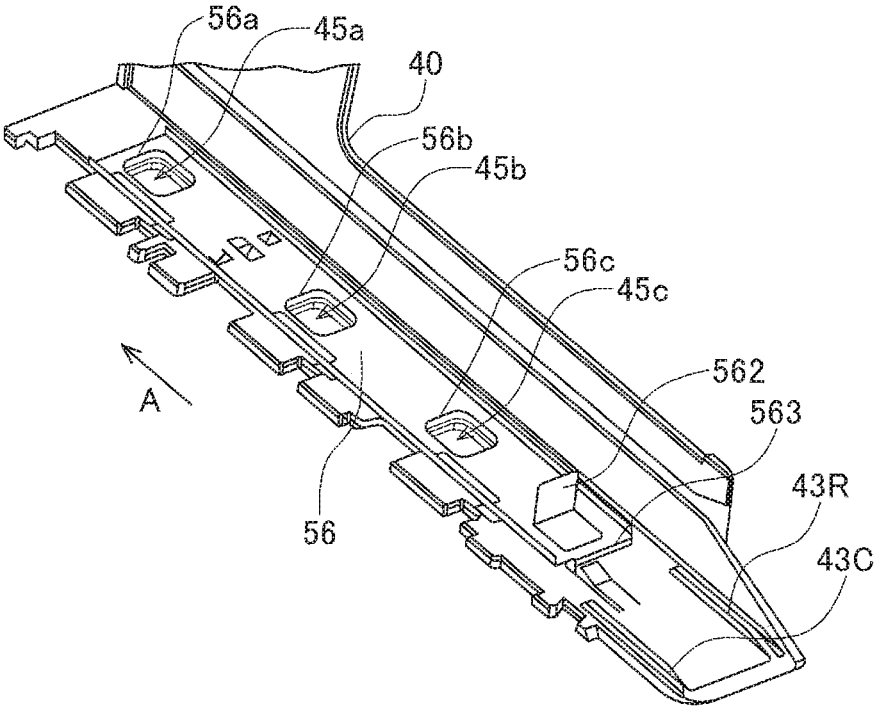
FIGS. 13A-13C are views for explaining engagement between the shutter and the stage in the embodiment.
Figure 13B:
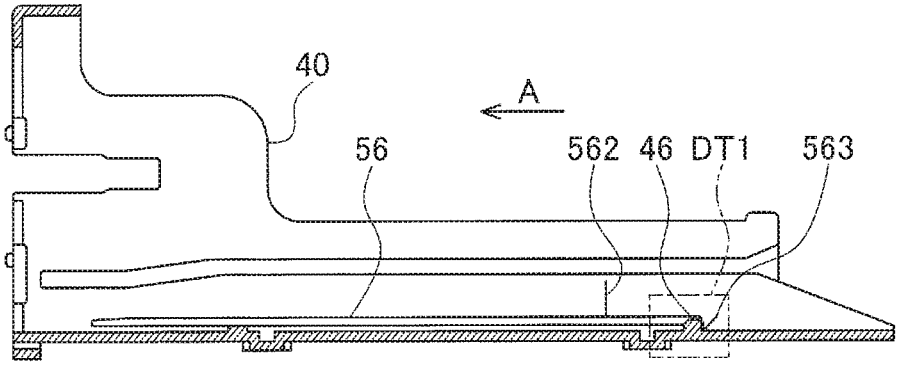
Figure 13C:
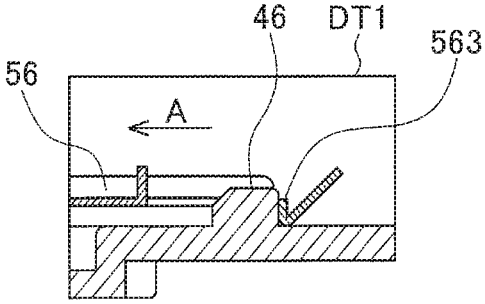

FIGS. 13A-13C are views for explaining engagement between the shutter and the stage in the embodiment, and illustrate a state where the engaged portion 563 of the shutter 56 and the projection 46 of the stage 40 are engaged with each other. FIG. 13A is a perspective view of the stage 40 and shutter 56. FIG. 13B is a sectional view of the stage 40 and shutter 56. FIG. 13C is an enlarged view of the engagement portion DT1 in FIG. 13B.

In FIGS. 13A-13C, the engaged portion 563 of the shutter 56 engages with the projection 46 of the stage 40, thereby restricts or prevents movement of the shutter 56 in the toner cartridge attachment direction indicated by arrow A in the drawings.

At this time, the shutter 56 is located at a position where the openings 56*a*, 56*b*, and 56*c* of the shutter 56 correspond to or face the openings 45*a*, 45*b*, and 45*c* of the stage 40.

Figure 18:
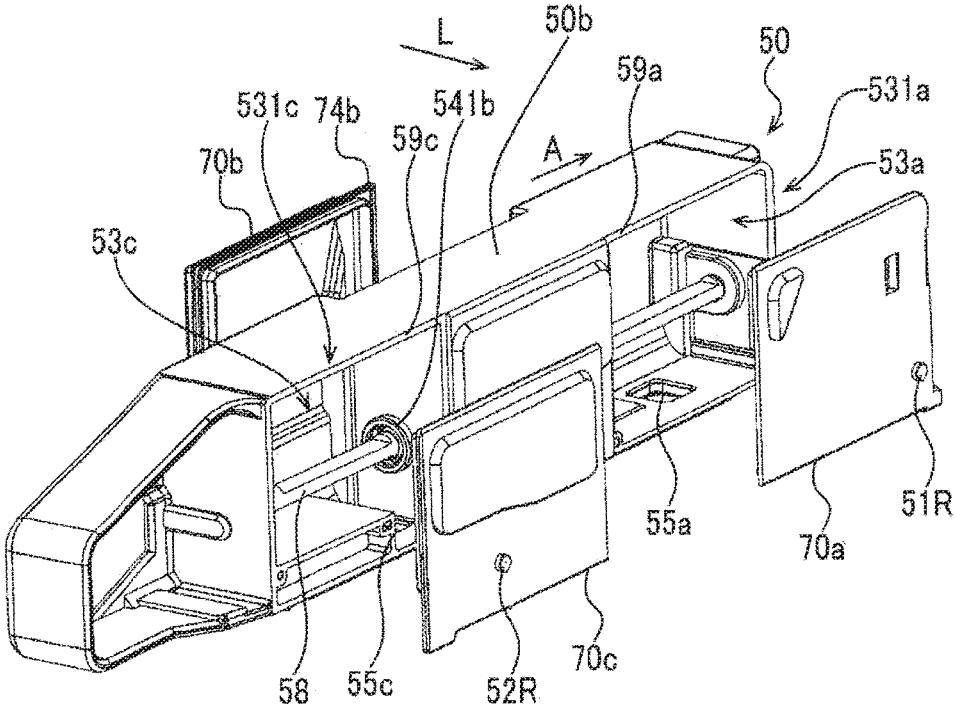
FIG. 18 is an exploded perspective view of the toner cartridge of the embodiment.
Figure 19:
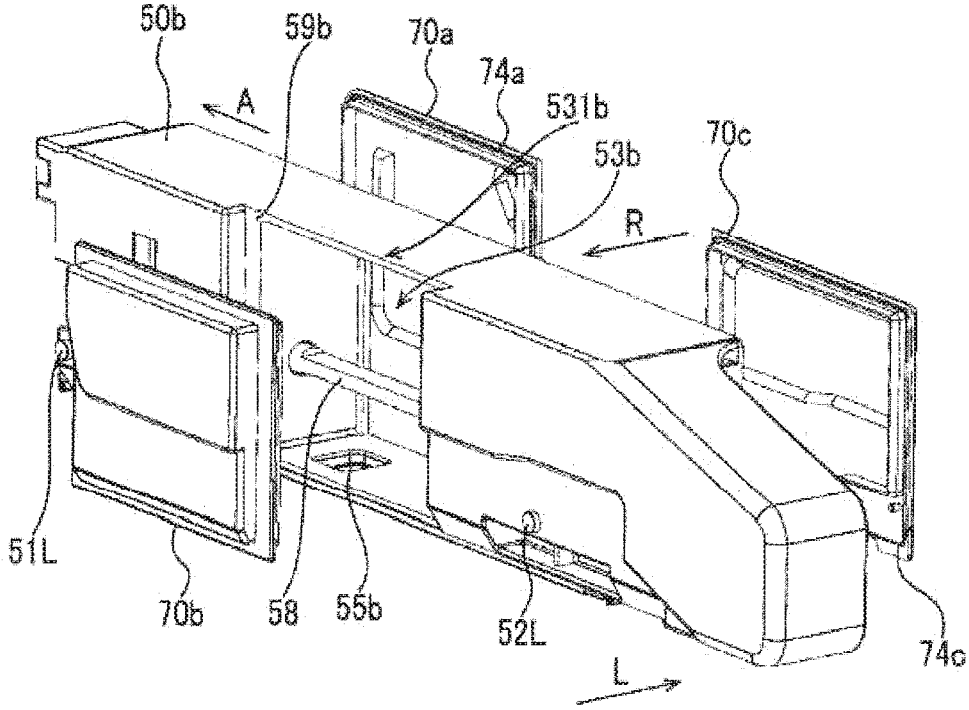
FIG. 19 is another exploded perspective view of the toner cartridge of the embodiment.

FIGS. 18 and 19 are exploded perspective views of the toner cartridge of the embodiment.

In FIGS. 18 and 19, the toner cartridge 50 includes a frame 50*b* and covers 70*a*, 70*b*, and 70*c* that close or seal openings 531*a*, 531*b*, and 531*c* of the toner storing portions 53*a*, 53*b*, and 53*c*. The covers 70*a*, 70*b*, and 70*c* are rectangular.

The toner storing portions 53*a*, 53*b*, and 53*c* are arranged in the frame 50*b*. The frame 50*b*, serving as a body of the toner cartridge 50, forms wall surfaces of the respective toner storing portions 53*a*, 53*b*, and 53*c*, and has the openings 531*a*, 531*b*, and 531*c* formed therein for the toner storing portions 53*a*, 53*b*, and 53*c*.

The cover 70*a* seals the opening 531*a* of the toner storing portion 53*a*. The cover 70*a* closes the opening 531*a* of the toner storing portion 53*a* by being joined to a welded portion 59*a* of the opening 531*a* that has a substantially hollow square shape and is provided in the frame 50*b* of the toner cartridge 50.

The cover 70*b* seals the opening 531*b* of the toner storing portion 53*b*. The cover 70*b* closes the opening 531*b* of the toner storing portion 53*b* by being joined to a welded portion 59*b* of the opening 531*b* that has a substantially hollow square shape and is provided in the frame 50*b* of the toner cartridge 50.

The cover 70*b* seals the opening 531*b* of the toner storing portion 53*b*. The cover 70*b* closes the opening 531*b* of the toner storing portion 53*b* by being joined to a welded portion 59*b* of the opening 531*b* that has a substantially hollow square shape and is provided in the frame 50*b* of the toner cartridge 50.

The cover 70*c* seals the opening 531*c* of the toner storing portion 53*c*. The cover 70*c* closes the opening 531*c* of the toner storing portion 53*c* by being joined to a welded portion 59*c* of the opening 531*c* that has a substantially hollow square shape and is provided in the frame 50*b* of the toner cartridge 50.

The covers 70*a* and 70*c* are disposed on the right (R) side as viewed in the toner cartridge attachment direction indicated by arrow A in the drawings, and the cover 70*b* is disposed on the left (L) side as viewed in the toner cartridge attachment direction.

Thus, the opening 531*a* of the toner storing portion 53*a* and the opening 531*c* of the toner storing portion 53*c* are formed on the right (R) side as viewed in the toner cartridge attachment direction indicated by arrow A in the drawings, and the opening 531*b* of the toner storing portion 53*b* is formed on the left (L) side as viewed in the toner cartridge attachment direction.

In the cover 70*a*, the post 51R is formed at a position corresponding to the post 51L. In the cover 70*c*, the post 52R is formed at a position corresponding to the post 52L.

In the cover 70*a*, a welding rib 74*a* serving as a welding portion is formed. The welding rib 74*a* has a substantially hollow square shape. The welding rib 74*a* and the welded portion 59*a*, which serves as an engaged portion (or engaged groove) and is provided in the frame 50*b* of the toner cartridge 50, are engaged with and welded to each other. This closes or seals the opening 531*a* of the toner storing portion 53*a* and prevents toner from leaking from the toner storing portion 53*a*.

In the cover 70*b*, a welding rib 74*b* serving as a welding portion is formed. The welding rib 74*b* has a substantially hollow square shape. The welding rib 74*b* and the welded portion 59*b*, which serves as an engaged portion (or engaged groove) and is provided in the frame 50*b* of the toner cartridge 50, are engaged with and welded to each other. This closes or seals the opening 531*b* of the toner storing portion 53*b* and prevents toner from leaking from the toner scoring portion 53*b*.

In the cover 70*c*, a welding rib 74*c* serving as a welding portion is formed. The welding rib 74*c* has a substantially hollow square shape. The welding rib 74*c* and the welded portion 59*c*, which serves as an engaged portion (or engaged groove) and is provided in the frame 50*b* of the toner cartridge 50, are engaged with and welded to each other. This closes or seals the opening 531*c* of the toner storing portion 53*c* and prevents toner from leaking from the toner storing portion 53*c*.

In this embodiment, the openings 531*a*, 531*b*, and 531*c* of the toner storing portions 53*a*, 53*b*, and 53*c* have different shapes, and the covers 70*a*, 70*b*, and 70*c* have shapes corresponding to the shapes of the openings 531*a*, 531*b*, and 531*c*, respectively.

As above, in this embodiment, each toner storing portion has an opening, and for each toner storing portion, a cover that closes the opening of the toner storing portion is provided. The covers for the toner storing portions are separately provided. The covers correspond to the openings of the toner storing portions on a one-to-one basis. Specifically, for the toner storing portions 53*a*, 53*b*, and 53*c*, the covers 70*a*, 70*b*, and 70*c* that respectively close the openings 531*a*, 531*b*, and 531*c* of the toner storing portions 53*a*, 53*b*, and 53*c* are provided. The covers 70*a*, 70*b*, and 70*c* are separately provided to correspond to the openings 531*a*, 531*b*, and 531*c*.

Further, the openings 531*a* and 531*c* of the toner storing portions 53*a* and 53*c* and the covers 70*a* and 70*c* that close the openings 531*a* and 531*c* are provided on one side as viewed in the toner cartridge attachment direction, and the opening 531*b* of the toner storing portion 53*b* adjacent to the toner storing portions 53*a* and 53*c* and the cover 70*b* that closes the opening 531*b* are provided on the other side as viewed in the toner cartridge attachment direction.

Thus, the toner cartridge 50 of this embodiment includes at least a first developer chamber (e.g., the toner storing portion 53*a*) and a second developer chamber (e.g., the toner storing portion 53*b*) that are arranged adjacent to each other. The opening (e.g., the opening 531*a*) of the first developer chamber and the opening (e.g., the opening 531*b*) of the second developer chamber are formed in different sides (e.g., opposite sides) of the frame 50*b*.

In this embodiment, the opening (e.g., the opening 531*b*) of the second developer chamber is formed in a side (or side surface) of the frame 50*b* opposite to the side of the frame 50*b* in which the opening (e.g., the opening 531*a*) of the first developer chamber is formed. However, this is not mandatory, and the opening of the second developer chamber may be formed in an upper or lower side (or surface) of the toner cartridge 50.

The same applies to a case where the toner storing portion 53*b* is taken as the first developer chamber and the toner storing portion 53*c* is taken as the second developer chamber.

The covers will now be described.

Figure 20A:
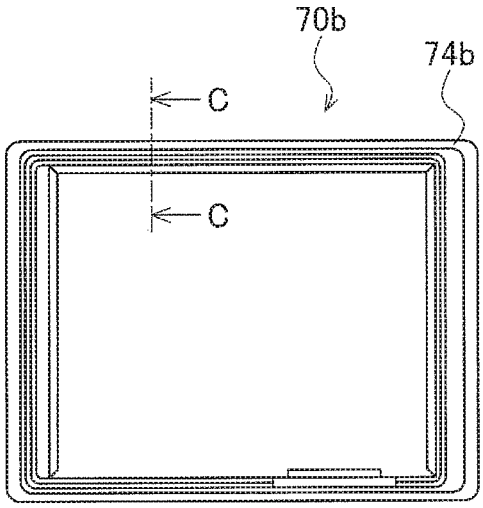
FIGS. 20A and 20B are views for explaining covers of the embodiment.
Figure 20B:
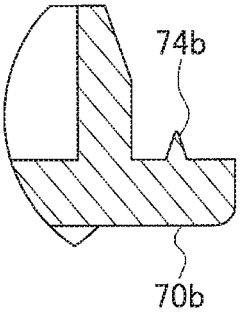

FIGS. 20A and 20B are views for explaining the covers of the embodiment. The covers 70*a*, 70*b*, and 70*c* illustrated in FIGS. 18 and 19 have substantially the same configuration, and FIG. 20 illustrates a configuration of the cover 70*b*.

FIG. 20A is a view of the cover 70*b* in FIG. 18 as viewed in the direction indicated by arrow R in FIG. 19. FIG. 20B is a sectional view of the welding rib 74*b* taken along line C-C in FIG. 20A.

As illustrated in FIG. 20A, the welding rib 74*b*, which has a substantially hollow square shape, is formed on a surface of the cover 70*b* (illustrated in FIG. 19) on the toner storing portion 53*b* side.

As illustrated in FIG. 20B, the welding rib 74*b* is a projection having, for example, a substantially isosceles triangular cross section.

Figure 21:
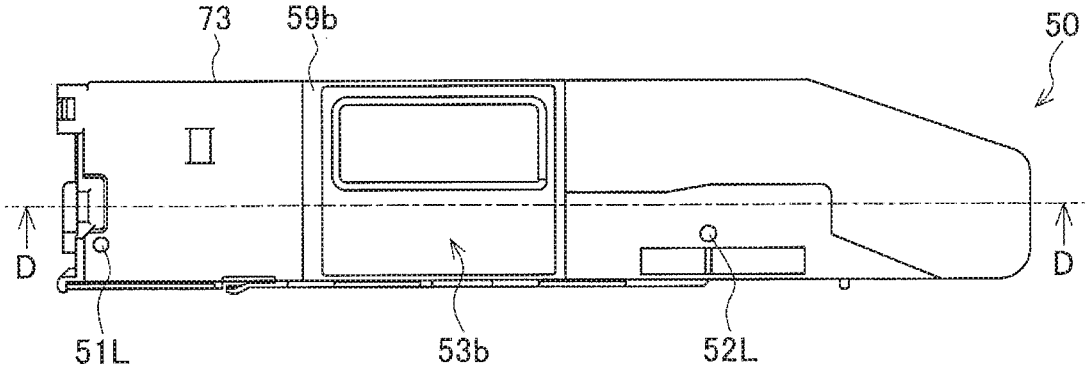
FIG. 21 is a side view of the toner cartridge of the embodiment.

FIG. 21 is a side view of the toner cartridge of the embodiment as viewed in the direction of arrow L in FIG. 19.

The welding rib 74*b* of the cover 70*b* illustrated in FIGS. 20A and 20B is fitted into the welded portion 59*b* of the toner cartridge 50 illustrated in FIG. 21, and the welding rib 74*b* and welded portion 59*b* are welded together, so that the toner storing portion 53*b* is sealed.

In this manner, in this embodiment, the welding rib 74*b* is welded to the welded portion 59*b* of the toner cartridge 50 illustrated in FIG. 21, so that the opening 531*b* illustrated in FIG. 19 is sealed by the cover 70*b*.

Here, the welding is performed using, for example, ultrasonic welding. However, attachment of the cover 70*b* to the toner cartridge 50 is not limited to ultrasonic welding, and the cover 70*b* may be joined to the toner cartridge 50 with adhesive, silicone rubber, or double-sided adhesive tape, or by other methods.

Likewise, the cover 70*a* illustrated in FIGS. 18 and 19 is fitted into the welded portion 59*a* of the toner cartridge 50, and the welding rib 74*a* and welded portion 59*a* are welded together, so that the toner storing portion 53*a* is sealed; the cover 70*c* illustrated in FIGS. 18 and 19 is fitted into the welded portion 59*c* of the toner cartridge 50, and the welding rib 74*c* and welded portion 59*c* are welded together, so that the toner storing portion 53*c* is sealed.

An operation of the above-described configuration will be described.

First, an operation of the image forming apparatus will be briefly described with reference to FIG. 2.

A paper roll is set in the paper roll holder 3 by a user in such a manner that a leading end portion of the paper is drawn from the paper roll in front of the paper roll holder 3. Then, the cover 6 is closed, and the paper is nipped between the holder side conveying roller 9 and the cover side conveying roller 11.

With the paper nipped between the holder side conveying roller 9 and the cover side conveying roller 11, the image forming apparatus 1 rotates the holder side conveying roller 9 and rotates one conveying roller of each of the pairs of conveying rollers 22, 23, 24, 25, and 33, thereby conveying the paper to the transfer belt 29 along the conveying path 21.

The paper conveyed to the transfer belt 29 is conveyed by the transfer belt 29 and sequentially passes through between the photosensitive drums 30*a*, 30*b*, and 30*c* of the image forming portions 27*a*, 27*b*, and 27*c* and the transfer rollers 31*a*, 31*b*, and 31*c*. At this time, toner images formed on the surfaces of the photosensitive drums 30*a*, 30*b*, and 30*c* are transferred onto a printing surface of the paper.

The paper with the toner images transferred thereon is conveyed to the fixing unit 32, which fixes the toner images to the paper. The paper is then discharged by the pair of conveying rollers 33 through the paper outlet 20.

The paper is cut by the housing side cutter 26 to a predetermined length. Thus, a printed sheet cut to the predetermined length is discharged through the paper outlet 20.

Next, an operation of attaching the toner cartridge to the stage will be described with reference to FIGS. 14A, 14B, 15A-15C, 16A-16C, and 17A-17C. FIGS. 14A, 15A, 16A and 17A are left side views of the stage 40 and toner cartridge 50. FIGS. 14B, 15B, 16B, and 17B are sectional views of the stage 40 and toner cartridge 50 corresponding to FIGS. 14A, 15A, 16, and 17A. FIGS. 15C, 16C, and 17C are enlarged views of the parts DT2, DT3, and DT4 of FIGS. 15B, 16B, and 17E, respectively.

Figure 14A:
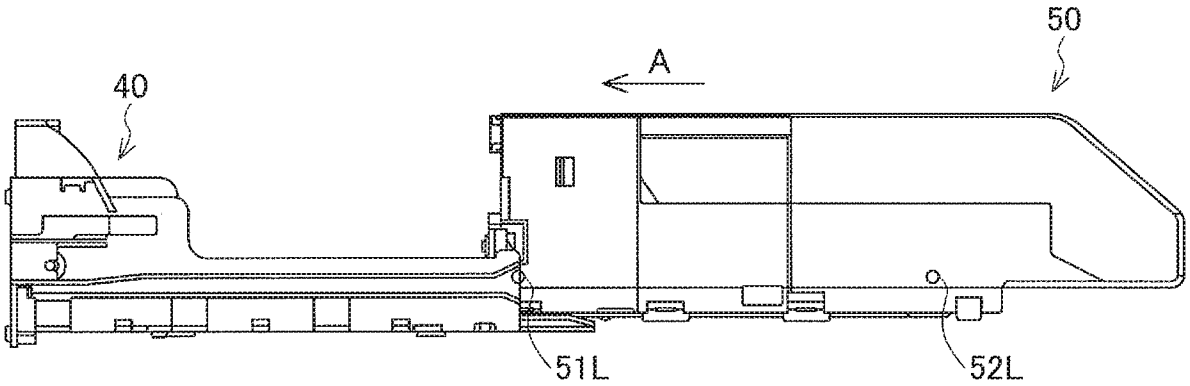
FIGS. 14A and 14B are views for explaining a position where the toner cartridge begins to engage with the stage in the embodiment.
Figure 14B:
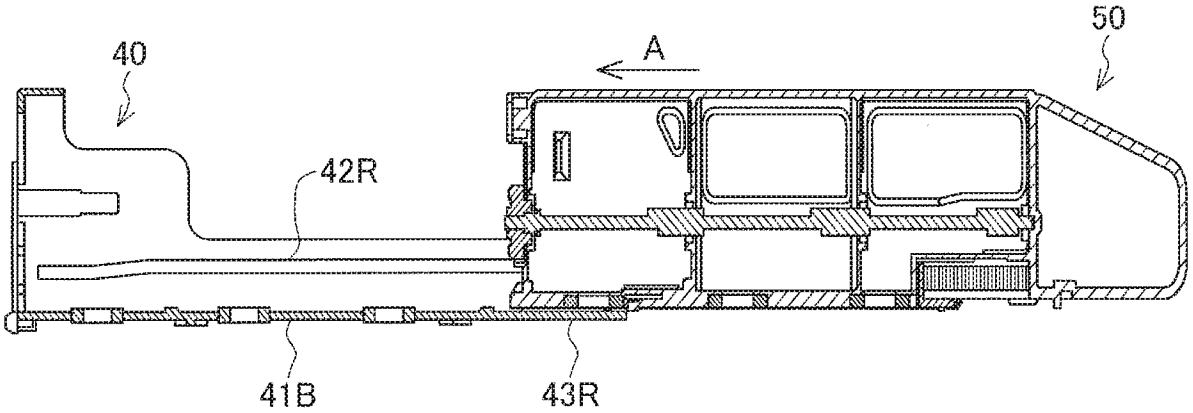

FIGS. 14A and 14B illustrate a state before the posts 51R and 51L of the toner cartridge 50 are fitted into the rails 42R and 42L of the stage 40.

At this time, a front end portion of the bottom surface of the toner cartridge 50 in the toner cartridge attachment direction indicated by arrow A in the drawings abuts the limiters 43R and 43L. This separates the bottom surface of the toner cartridge 50 from the bottom plate 41B of the stage 40 and forms a predetermined gap therebetween.

From this state, the posts 51R and 51L of the toner cartridge 50 are fitted into the rails 42R and 42L of the stage 40, and the toner cartridge 50 is slid in the toner cartridge attachment direction indicated by arrow A in the drawings.

Figure 15A:
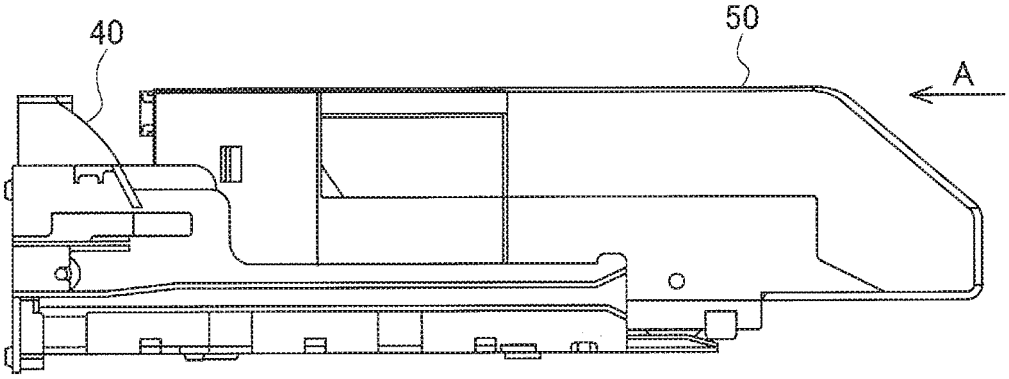
FIGS. 15A-15C are views for explaining openings of the toner cartridge of the embodiment.
Figure 15B:
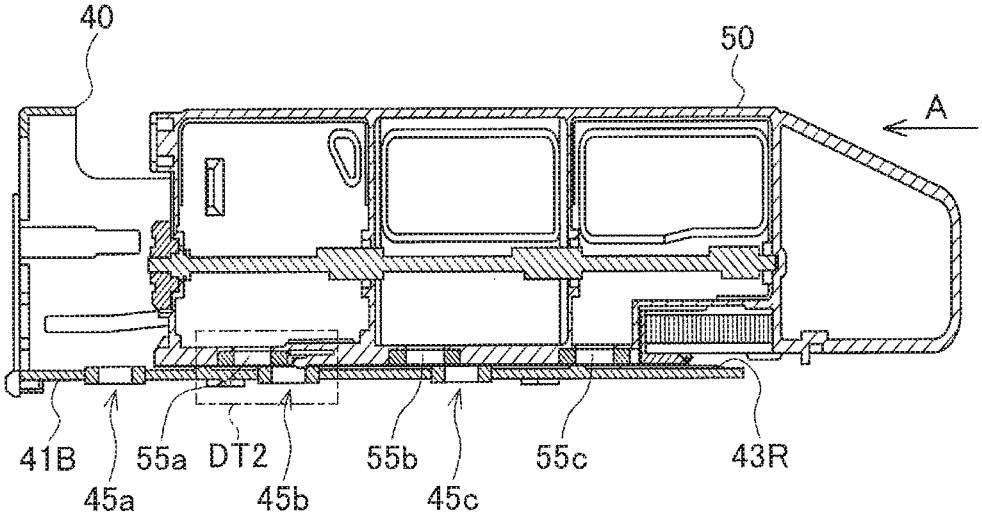
Figure 15C:
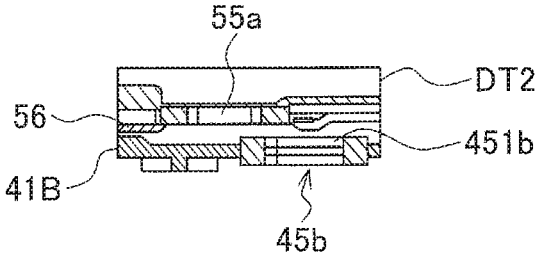

FIGS. 15A-15C illustrate a state immediately before the posts 51L and 51R of the toner cartridge 50 illustrated in FIGS. 3 and 4 reach the first corners 422 of the rails 42R and 42L of the stage 40 illustrated in FIG. 8.

At this time, as illustrated in FIGS. 15*b* and 15C, the bottom surface of the toner cartridge 50 and the bottom plate 41B of the stage 40 are separated from each other, and a predetermined gap is formed therebetween.

This is because, as illustrated in FIG. 8, the first linear sections 421 of the rails 42R and 42L of the stage 40 are higher by the distance Db than the second linear sections 425. The bottom surface of the toner cartridge 50 and the bottom plate 41B of the stage 40 are separated from each other, and the predetermined gap is formed therebetween.

Also, on the upstream side in the toner cartridge attachment direction indicated by arrow A in the drawings, the limiters 43R and 43L abut the bottom surface of the toner cartridge 50, thereby separating the bottom surface of the toner cartridge 50 from the bottom plate 41B of the stage 40 and maintaining the predetermined gap formed therebetween.

Thus, as illustrated in FIG. 15C, a predetermined gap is formed between the shutter 56 of the toner cartridge 50 and the sealing member 451*b* of the stage 40, in the up-down direction.

Also, a predetermined gap is formed between the shutter 56 of the toner cartridge 50 and the sealing member 451*c* (see FIG. 11) of the stage 40, in the up-down direction.

In this manner, until the opening 55*a* of the toner cartridge 50 passes through the opening 45*b* of the stage 40, the shutter 56 of the toner cartridge 50 and the sealing member 451*b* of the opening 45*b* of the stage 40 are separated from each other. Thus, the bottom surface of the toner cartridge 50 does not come into contact with the openings 45*a*, 45*b*, and 45*c* of the stage 40.

Thus, it is possible to prevent the bottom surface of the toner cartridge 50 and the openings 45*a*, 45*b*, and 45*c* of the stage 40 from being contaminated by toners of the different colors.

In the state illustrated in FIGS. 14A and 14B and the state illustrated in FIGS. 15A and 15B, the shutter 56 of the toner cartridge 50 is urged by the spring 57 to close the openings 55*a*, 55*b*, and 55*c* as illustrated in FIG. 5.

The toner cartridge 50 is further slid in the toner cartridge attachment direction indicated by arrow A in the drawings.

Figure 16A:
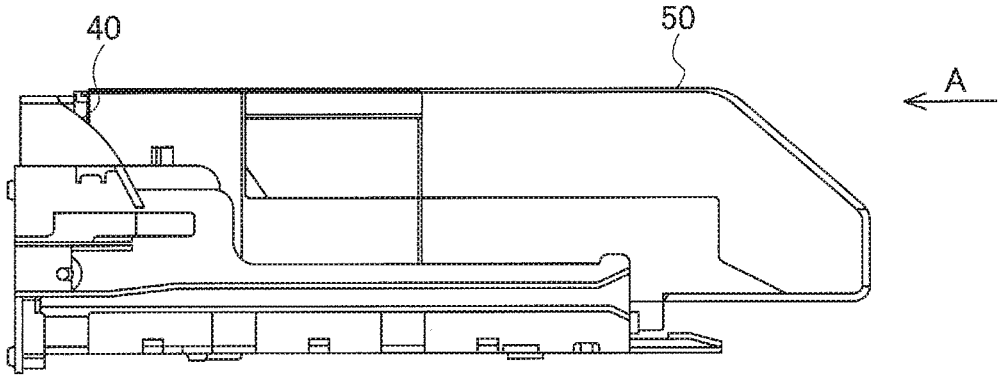
FIGS. 16A-16C are views for explaining a position where the shutter begins engagement in the embodiment.
Figure 16B:
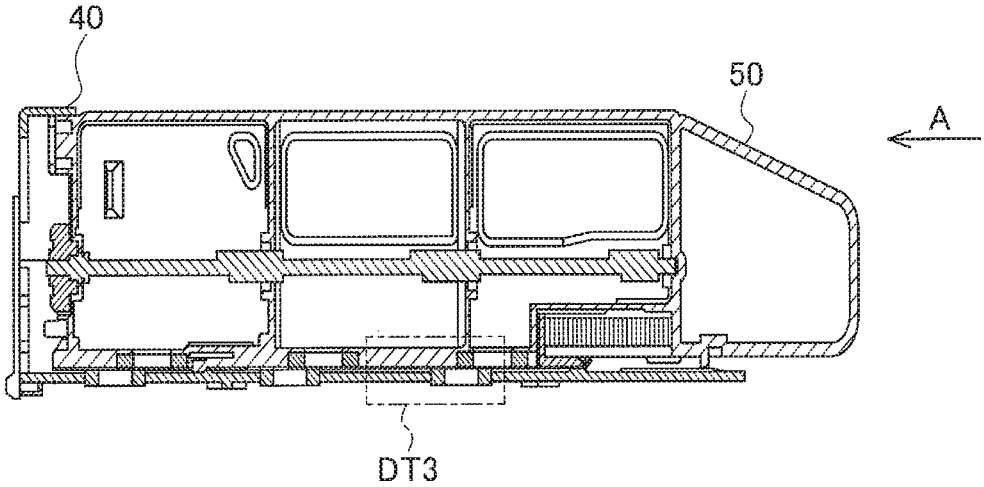
Figure 16C:
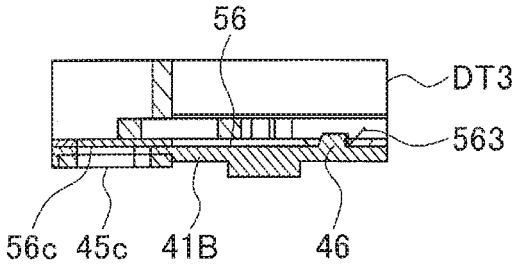

FIGS. 16A-16C illustrate a state where the posts 51R and 51L of the toner cartridge 50 illustrated in FIGS. 3 and 4 have reached the second corners 424 the upstream ends of the second linear sections 425 in the toner cartridge attachment direction) of the rails 42R and 42L of the stage 40 illustrated in FIG. 8.

At this time, as illustrated in FIGS. 16B and 16C, the bottom surface (or the first surface 502 illustrated in FIG. 9) of the toner cartridge 50 is close to the bottom plate 41B (or the second surface 402 illustrated in FIG. 9) of the stage 40, and the projection 46 of the stage 40 engages with the engaged portion 563 of the shutter 56 of the toner cartridge 50.

This is because, as illustrated in FIG. 8, the second linear sections 425 of the rails 42R and 42L of the stage 40 are lower by the distance Db than the first linear sections 421. The bottom surface of the toner cartridge 50 is close to the bottom plate 41B of the stage 40, and the engaged portion 563 of the shutter 56 of the toner cartridge 50 engages with the projection 46 of the stage 40.

This prevents or limits movement of the shutter 56 in the toner cartridge attachment direction. At this time, as illustrated in FIG. 16C, the opening 56*c* of the shutter 56 is located at a position corresponding to or facing the opening 45*c* of the stage 40, and likewise the openings 56*a* and 56*b* of the shutter 56 are located at positions corresponding to or facing the openings 45*a* and 45*b* of the stage 40 as illustrated in FIG. 6.

Further, since the height difference H between the posts 51R and 51L and the posts 52R and 52L of the toner cartridge 50 is equal to the distance Db, which is the difference in height between the second linear sections 425 and the first linear sections 421 of the rails 42R and 42L of the stage 40 illustrated in FIG. 8, as illustrated in FIG. 10, when the toner cartridge 50 moves in the attachment direction, the toner cartridge 50 is kept parallel to the stage 40, i.e., horizontal. This allows the three openings 56*a*, 56*b*, and 56*c* of the shutter 56 to respectively come into close contact with the three openings 45*a*, 45*b*, and 45*c* of the stage 40.

The toner cartridge 50 is further slid in the toner cartridge attachment direction indicated by arrow A in the drawings.

Figure 17A:
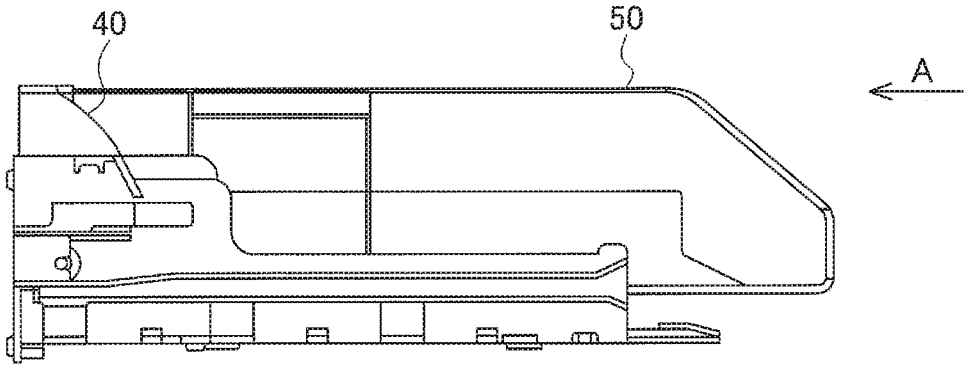
FIGS. 17A-17C are views for explaining an attachment position of the toner cartridge in the embodiment.
Figure 17B:
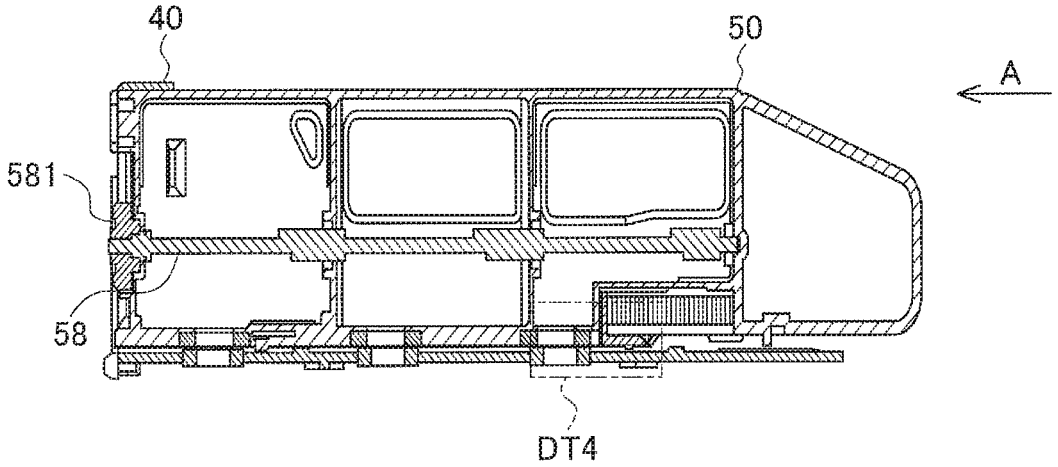
Figure 17C:
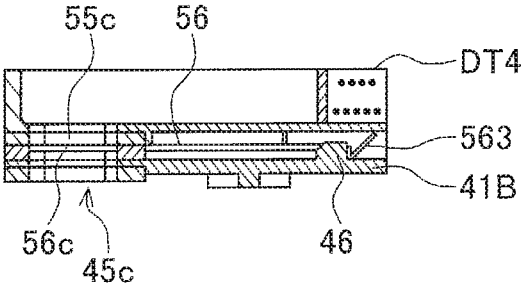

FIGS. 17A-17C illustrate a state where the posts 51R and 51L of the toner cartridge 50 illustrated in FIGS. 3 and 4 have reached the terminal ends 426 of the rails 42R and 42L or stage 40 illustrated in FIG. 8.

At this time, as illustrated in FIGS. 17B and 17C, the bottom surface of the toner cartridge 50 is kept close to the bottom plate 41B of the stage 40, and the opening 55*c* of the toner cartridge 50 is located at a position corresponding to or facing the opening 56*c* of the shutter 56 and the opening 45*c* of the stage 40, and likewise the openings 55*a* and 55*b* of the toner cartridge 50 illustrated in FIG. 6 are located at positions corresponding to or facing the openings 56*a* and 56*b* of the shutter 56 and the openings 45*a* and 45*b* of the stage 40 illustrated in FIG. 7.

This is because, when the posts 51R and 51L of the toner cartridge 50 illustrated in FIGS. 3 and 4 reach the terminal ends 426 of the rails 42R and 42L of the stage 40 illustrated in FIG. 8, movement of the toner cartridge 50 is prevented or limited at a position where the openings 55*a*, 55*b*, and 55*c* of the toner cartridge 50 respectively correspond to or face the openings 56*a*, 56*b*, and 56*c* of the shutter 56, which has already been prevented from moving in the toner cartridge attachment direction.

Accordingly, the toner stored in the toner cartridge 50 falls through the openings (specifically, the openings 55*a*, 55*b*, and 55*c* illustrated in FIG. 6) of the toner cartridge 50, the openings (specifically, the openings 56*a*, 56*b*, and 56*c* illustrated in FIG. 6) of the shutter 56, and the openings (specifically, the openings 45*a*, 45*b*, and 45*c* illustrated in FIG. 7) of the stage 40, and is supplied to the image forming portions 27*a*, 27*b*, and 27*c* illustrated in FIG. 1.

When the posts 51R and 51L of the toner cartridge 50 illustrated in FIGS. 3 and 4 reach the terminal ends 426 of the rails 42R and 42L of the stage 40 illustrated in FIG. 8, the gear 581 meshes with a gear connected to the drive source of the image forming apparatus 1 illustrated in FIG. 2, allowing the agitating member 53 to be rotated.

Next, a method of assembling the toner cartridge will be described.

Figure 22:
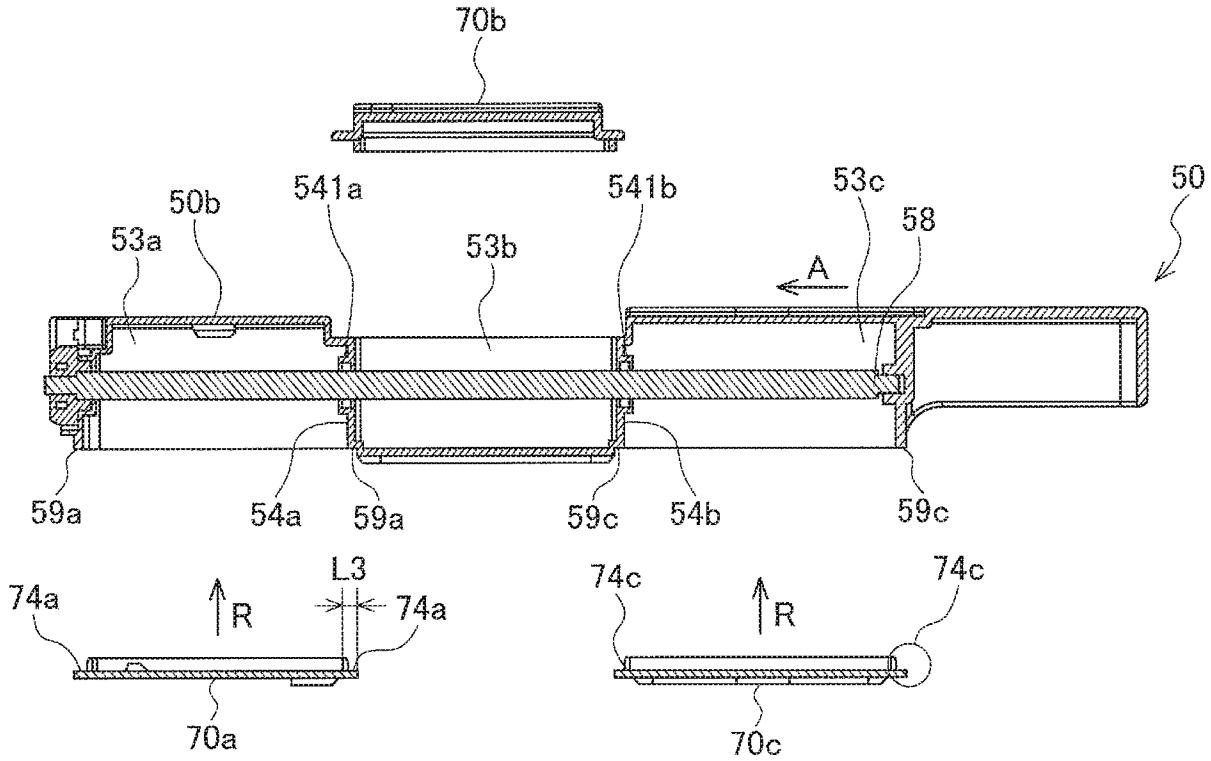
FIG. 22 is a sectional view of the toner cartridge of the embodiment before the covers are attached.
Figure 23A:
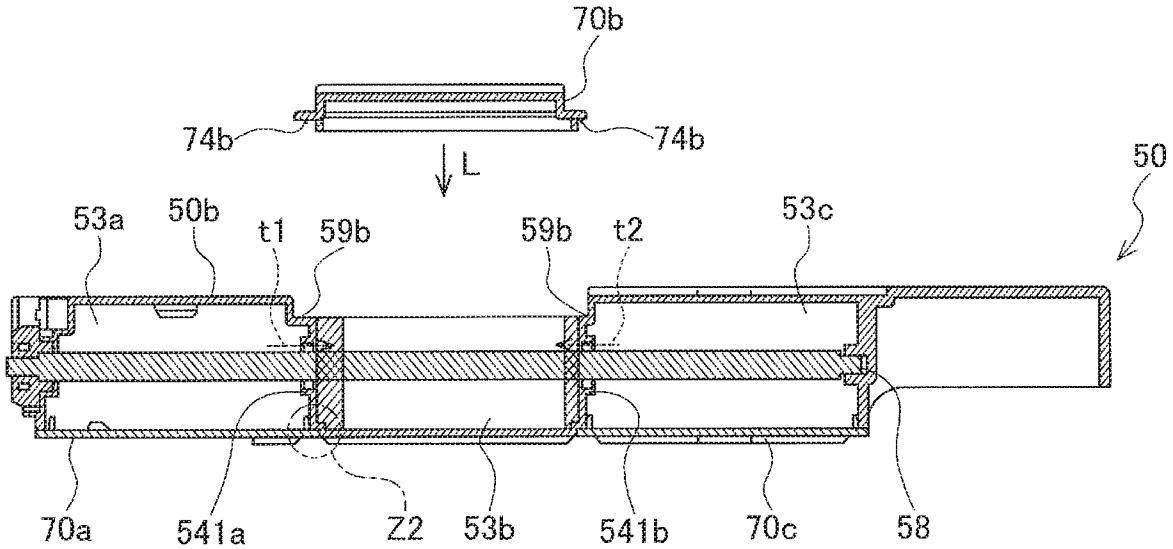
FIGS. 23A and 23B are sectional views of the toner cartridge of the embodiment after two of the covers have been attached.
Figure 23B:
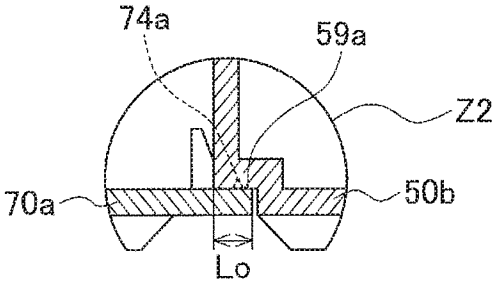
Figure 24:
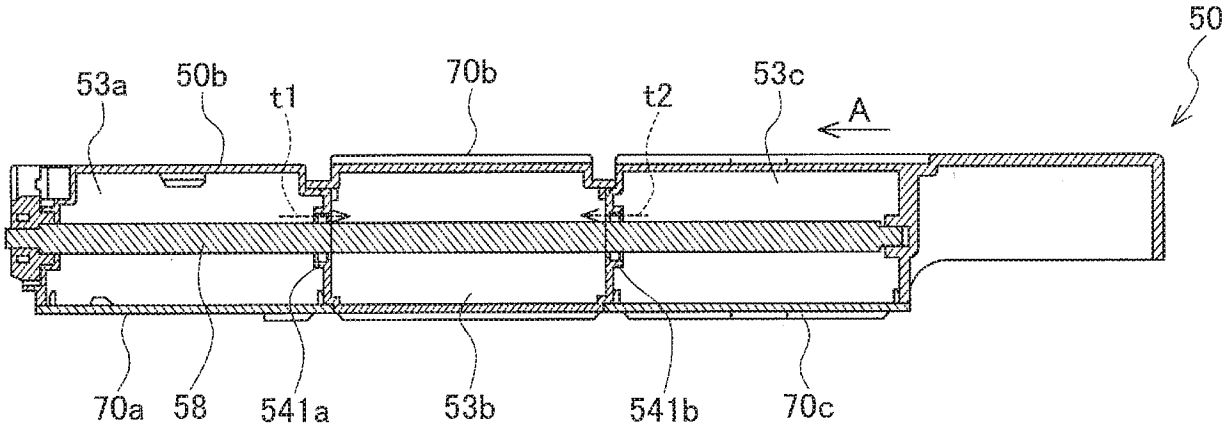
FIG. 24 is a sectional view of the toner cartridge of the embodiment after all the covers have been attached.

FIG. 22 is a sectional view of the toner cartridge of the embodiment before the covers are attached. FIGS. 23A and 23B are sectional views of the toner cartridge of the embodiment after two of the covers are attached. FIG. 24 is a sectional view of the toner cartridge of the embodiment after all the covers are attached, and is a sectional view taken along line D-D in FIG. 21.

FIG. 23B is an enlarged view of the joint part Z2 between the welded portion 59*a* of the frame 50*b* and the welding rib 74*a* of the cover 70*a* in FIG. 23A.

In FIG. 22, the cover 70*a* is moved toward the toner storing portion (or toner chamber) 53*a* in the direction indicated by arrow R in the drawing, and the welding rib 74*a* of the cover 70*a* and the welded portion 59*a* of the toner storing portion 53*a* are fitted together. With the welding rib 74*a* and the welded portion 59*a* fitted together, the welding rib 74*a* is melted by welding, so that the cover 70*a* is fixed to the frame 50*b* as illustrated in FIG. 23A.

At this time, as illustrated in FIG. 23B, the welding rib 74*a* of the cover 70*a* is melted and joined to the welded portion 59*a* of the toner storing portion 53*a*, so that the cover 70*a* is fixed to the frame 50*b*.

Likewise, the cover 70*c* is moved toward the toner storing portion (or toner chamber) 53*c* in the direction indicated by arrow R in FIG. 22, and the welding rib 74*c* of the cover 70*c* and the welded portion 59*c* of the toner storing portion 53*c* axe fitted together. With the welding rib 74*c* and the welded portion 59*c* fitted together, the welding rib 74*c* is melted by welding, so that the cover 70*c* is fixed to the frame 50*b* as illustrated in FIG. 23A.

After the covers 70*a* and 70*c* have been fixed to the frame 50*b* as illustrated in FIG. 23A, the toner storing portions 53*a* and 53*c* are filled with the respective toners. For example, the toner storing portion 53*a* is filled with yellow toner, and the toner storing portion 53*c* is filled with cyan toner.

At this time, the toners are supplied through the openings 55*a* and 55*c* illustrated in FIG. 6. It is also possible that the toner storing portions 53*a* and 53*c* are filled with the respective toners before the covers 70*a* and 70*c* are welded, and then the covers 70*a* and 70*c* are welded.

After the toner storing portions 53*a* and 53*c* have been filled with the toners, the toner cartridge 50 is shaken, and it is visually checked whether toner leaks from the toner storing portions 53*a* and 53*c* of the toner cartridge 50 being assembled.

When it is determined that no toner leaks from the toner storing portions 53*a* and 53*c* into the toner storing portion 53*b* adjacent to the toner storing portions 53*a* and 53*c*, no toner leaks from between the welding rib 74*a* and the welded portion 59*a*, and no toner leaks from between the welding rib 74*c* and the welded portion 59*c*, it can be determined that there is no failure in assembly of the toner cartridge 50.

On the other hand, when it is determined that toner (e.g., yellow toner) in the toner storing portion 53*a* leaks into the toner storing portion 53*b* from the direction indicated by arrow t1 in FIG. 23A, it can be seen that there is some kind of failure in the sealing member 541*a*.

When it is determined that toner (e.g., cyan toner) in the toner storing portion 53*c* leaks into the toner storing portion 53*b* from the direction indicated by arrow t2 in FIG. 23A, it can be seen that there is some kind of failure in the sealing member 541*b*.

When it is determined that toner leaks from between the welding rib 74*a* and the welded portion 59*a* or between the welding rib 74*c* and the welded portion 59*c*, it can be seen that the welding is improper and there is some kind of failure in the welding equipment, parts, or the like.

After it is determined that no toner leaks from the toner storing portions 53*a* and 53*c* of the toner cartridge 50 being assembled, as illustrated in FIG. 23A, the cover 70*b* is moved toward the toner storing portion 53*b* in the direction indicated by arrow L in the drawing, and the welding rib 74*b* of the cover 70*b* and the welded portion 59*b* of the toner storing portion 53*b* are fitted together. With the welding rib 74*b* and the welded portion 59*b* fitted together, the welding rib 74*b* is melted by welding, so that the cover 70*b* is fixed to the frame 50*b* as illustrated in FIG. 24.

With the cover 70*b* fixed Lo the frame 50*b* as illustrated in FIG. 24, the toner storing portion 53*b* is filled with the corresponding toner (e.g., magenta toner).

At this time, the toner is supplied through the opening 55*b* illustrated in FIG. 6. It is also possible that the toner storing portion 53*b* is filled with the corresponding toner before the cover 70*b* is welded, and then the cover 70*b* is welded.

After the toner storing portion 53*b* has been filled with the toner, the toner cartridge 50 is shaken again, and it is visually checked whether toner leaks from the toner storing portion 53*b* of the toner cartridge 50 being assembled.

When it is determined that no toner leaks from between the welding rib 74*b* and the welded portion 59*b*, it can be determined that there is no failure in assembly of the toner cartridge 50.

On the other hand, when it is determined that toner leaks from between the welding rib 74*b* and the welded portion 59*b*, it can be seen that the welding is improper and there is some kind of failure in the welding equipment, parts, or the like.

Since, at the stage where the covers 70*a* and 70*c* were fixed to the frame 50*b* as illustrated in FIG. 23A, the sealing members 541*a* and 541*b* were determined to have no failure, there is no worry about toner leakages between the toner storing portions 53*a* and 53*b* and between the toner storing portions 53*c* and 53*b*, and mixture of toners of different colors.

As above, by checking the toner sealability of the sealing members 541*a* and 541*b*, and the toner sealability between the welding rib 74*a* and the welded portion 59*a*, between the welding rib 74*b* and the welded portion 59*b*, and between the welding rib 74*c* and the welded portion 59*c*, it is possible to check that there is no toner leakage in the toner cartridge 50.

A toner cartridge of a comparative example will now be described.

Figure 25A:
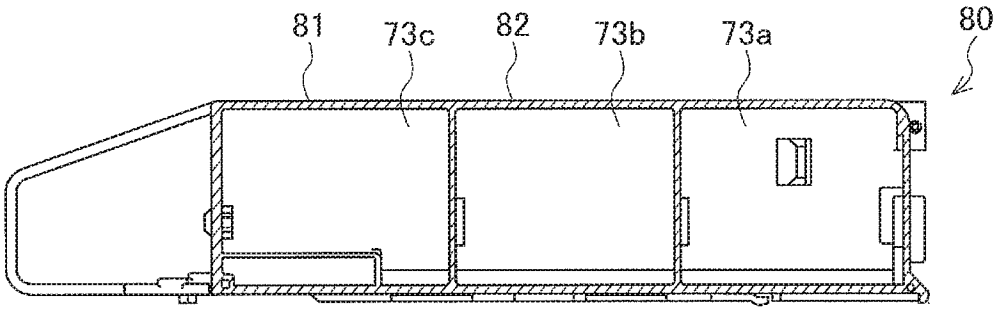
FIGS. 25A and 25B are views for explaining a toner cartridge of a comparative example.
Figure 25B:
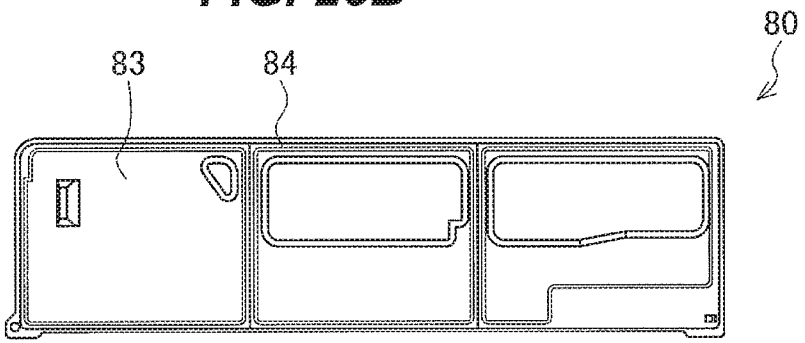
(RELATED ART) FIG. 25B
Figure 26:
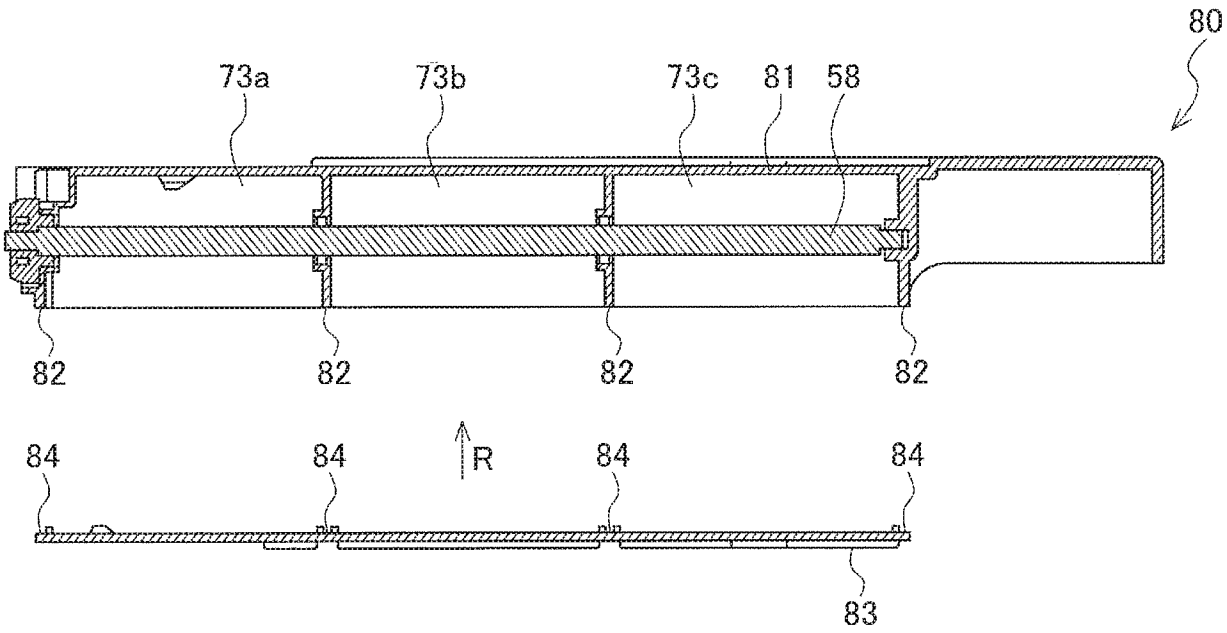
FIG. 26 is a sectional view of the toner cartridge of the comparative example before a cover is attached.
Figure 27:
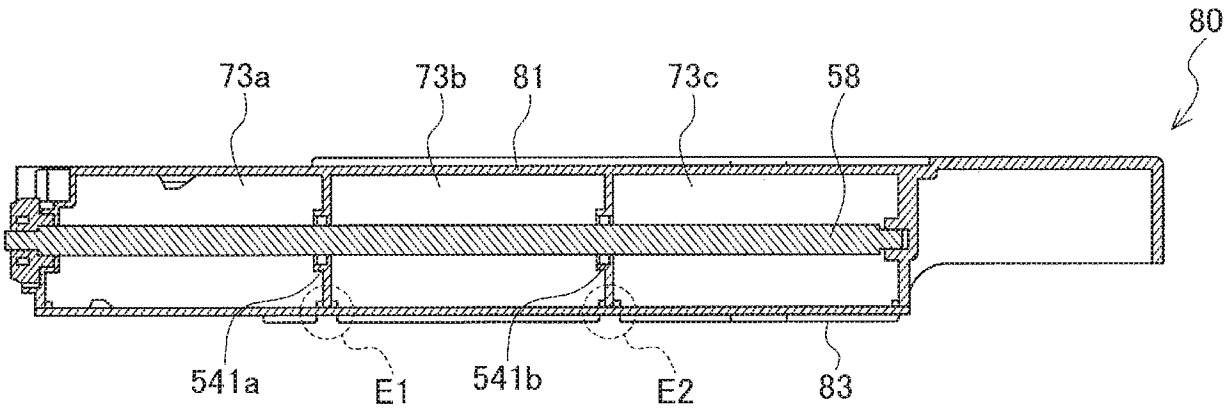
FIG. 27 is a sectional view of the toner cartridge of the comparative example after the cover has been attached.

FIGS. 25A and 25B are explanatory views of the toner cartridge 80 of the comparative example. FIG. 25A is a view of the toner cartridge 80 as viewed from the right. FIG. 25B is a view of a cover 83 as viewed from the left. FIG. 26 is a sectional view of the toner cartridge 80 of the comparative example before the cover 83 is attached. FIG. 27 is a sectional view of the toner cartridge 80 of the comparative example after the cover 83 is attached. FIGS. 26 and 27 correspond to FIGS. 22, 23A, 23B, and 24.

As illustrated in FIG. 25A, the toner cartridge 80 of the comparative example includes a frame 81 in which toner storing portions (or toner chambers) 73*a*, 73*b*, and 73*c* are formed. Each of the toner storing portions 73*a*, 73*b*, and 73*c* has an opening. All the openings of the toner storing portions 73*a*, 73*b*, and 73*c* are formed to face to the right. Welded portions 82 indicated by hatching are each formed in a substantially hollow square shape, and are arranged to form rims of the openings of the toner storing portions 73*a*, 73*b*, and 73*c*.

As illustrated in FIG. 25B, the cover 83 is a single body, and has welding ribs 84 formed therein to correspond to the welded portions 82.

The welding ribs 84 of the cover 83 are fitted into the welded portions 82 of the frame 81, and the welding ribs 84 are welded to the welded portions 82, so that the toner cartridge 80 of the comparative example is formed.

As illustrated in FIGS. 26 and 27, the toner cartridge 80 of the comparative example has the same configuration as the toner cartridge of the embodiment except far the frame 81 and cover 83.

As illustrated in FIG. 26, the cover 83 is moved toward the toner storing portions 73*a*, 73*b*, and 73*c* in the direction indicated by arrow R in the drawing, and the welding ribs 84 of the cover 83 and the welded portions 82 of the toner storing portions 73*a*, 73*b*, and 73*c* are fitted together. With the welding ribs 84 and welded portions 82 fitted together, the welding ribs 84 are melted by welding, so that the cover 83 is fixed to the frame 81.

With the cover 83 fixed to the frame 81 as illustrated in FIG. 27, the toner storing portions 73*a*, 73*b*, and 73*c* are filled with corresponding toners.

In the comparative example, even when after the toner storing portions 73*a*, 73*b*, and 73*c* are filled with the toners, the toner cartridge 80 is shaken to check for toner leakage from the toner storing portions 73*a*, 73*b*, and 73*c* of the toner cartridge 80, it is not possible to check for toner leakage due to failure of sealing member 541*a* or 541*b*, and toner leakage due to welding failure at a welding part E1 between the toner storing portions 73*a* and 73*b* or welding failure at a welding part E2 between the toner storing portions 73*b* and 73*c*.

As above, in the comparative example, it is not possible to completely check that no toner leaks from the toner storing portions 73*a*, 73*b*, and 73*c* of the toner cartridge 80. Thus, there is a possibility that a defective toner cartridge in which toner mixture may occur among the toner storing portions 73*a*, 73*b*, and 73*c* is shipped.

When it is tried to check for toner leakage after filling the toner storing portions 73*a* and 73*c* with toner, since the opening of the toner storing portion 73*b* is covered by the cover 83 and the toner storing portion 53*b* is not exposed, it is not possible to check whether toner leaks from the toner storing portions 73*a* and 73*c* into the toner storing portion 73*b*, and thus it is not possible to determine whether the assembled toner cartridge 80 is defective.

In this embodiment, the covers are separately provided to correspond to the shapes of the openings of the toner storing portions 53*a*, 53*b*, and 53*c*. Thus, it is possible to certainly check that no toner leakage occurs in the toner storing portions of the toner cartridge. Further, it is possible to prevent the covers from being erroneously attached to the toner storing portions 53*a*, 53*b*, and 53*c*.

Further, in this embodiment, as illustrated in FIG. 23A, the openings of the toner storing portions 53*a* and 53*c* and the covers 70*a* and 70*c* that close the openings are provided on one side (specifically, the right side), and the opening of the toner storing portion 53*b* adjacent to the toner storing portions 53*a* and 53*c* and the cover 70*b* that closes the opening are provided on another side (specifically, the left side). Thus, it is possible to reduce the length of the toner cartridge 50 in a direction in which the toner storing portions 53*a*, 53*b*, and 53*c* are arranged, thereby downsizing the toner cartridge 50.

This is because it is possible to locate the welding part between the welded portion 59*a* of the toner storing portion 53*a* and the cover 70*a* and the welding part between the welded portion 59*c* of the toner storing portion 53*c* and the cover 70*c* illustrated in FIG. 22 on a side opposite to the side on which the welding part between the welded portion 59*b* of the toner storing portion 53*b* and the cover 70*b* illustrated in FIG. 23A is located, and it is possible to, for example, between the toner storing portions 53*a* and 53*b*, reduce the length of the toner cartridge by the length Lo (in the arrangement direction of the toner storing portions 53*a*, 53*b*, and 53*c* illustrated in FIG. 23A) of the welding part, as illustrated in FIG. 23B. Likewise, it is possible to reduce the length of the toner cartridge, between the toner storing portions 53*b* and 53*c*.

Also, it is possible to easily provide the length Lo (in the arrangement direction of the toner storing portions 53*a*, 53*b*, and 53*c* illustrated in FIG. 23A) of the welding part illustrated in FIG. 23B. Further, the welded portion 59*a* illustrated in FIG. 23B can be easily formed. The welded portions 59*b* and 59*c* can also be easily formed.

This embodiment has described an example where the openings of the toner storing portions 53*a* and 53*c* and the covers 70*a* and 70*c* that close the openings are provided on the right side, and the opening of the toner storing portion 53*b* adjacent to the toner storing portions 53*a* and 53*c* and the cover 70*b* that closes the opening are provided on the left side, which is the opposite side. However, this is not mandatory. The openings of toner storing portions adjacent to each other and the covers that close the openings may be provided on different, but not opposite, sides. For example, the opening of the toner storing portion 53*b* and the cover 70*b* that closes the opening may be provided on a side, such as the upper side, other than the left side, which is the opposite side.

By arranging covers for toner storing portions adjacent to each other on different sides, it is possible to reduce a width of a welded portion for welding of the covers, reduce a thickness of the partition between the adjacent toner storing portions, and downsize the toner cartridge without reducing the amount of toner filled in the toner cartridge.

This embodiment has described an example where the toner cartridge 50 includes the three toner storing portions.

However, this is not mandatory, and the toner cartridge 50 may include two toner storing portions (e.g., a toner storing portion that stores dark black toner and a toner storing portion that stores light black toner), or may include four or more toner storing portions, such as four toner storing portions that store yellow, magenta, cyan, and black toners, or five toner storing portions that store special color toner (e.g., white toner) in addition to the above toners of the four colors.

As described above, in this embodiment, a cover is separately provided to correspond to an opening of each of toner storing portions of a toner cartridge. This makes it possible to easily check for toner leakage from each toner storing portion.

Further, it is possible to check for toner leakage of a toner cartridge during assembly thereof, thereby finding defects in the toner cartridge during assembly thereof.

Thus, it is possible to prevent erroneous shipment of a toner cartridge that can cause poor color representation due to mixture of toners of different colors.

Covers for toner storing portions adjacent to each other are disposed on different sides. This allows the toner cartridge to be downsized.

In this embodiment, the image forming apparatus has been described as a roll paper printer. However, the image forming apparatus is not limited to this, and may be a printer that prints on precut paper sheets, and may be any image forming apparatus, such as a copier, facsimile machine, multifunction peripheral (MFP), that includes multiple image forming units.

The present invention is not limited to the embodiment described above; it can be practiced in various other aspects without departing from the inventive scope.

What is claimed is:

1. A developer container comprising:

a body in which a plurality of developer chambers that store developer are arranged, each developer chamber having a first opening configured to allow the developer to pass therethrough and a second opening; and a plurality of covers that are fixed to the body and seal the second openings of the plurality of developer chambers, the plurality of covers being separately provided to correspond to the second openings of the plurality of developer chambers.

2. The developer container of claim 1, wherein each second opening has an engaged portion;

each cover has a welding portion that engages with the engaged portion of the second opening corresponding to the cover; and each welding portion is welded to the engaged portion corresponding to the welding portion so that each cover seals the second opening corresponding to the cover.

3. The developer container of claim 2, wherein each welding portion is a projection having a substantially isosceles triangular cross-section.

4. The developer container of claim 1, wherein the plurality of developer chambers include at least three developer chambers.

5. An image forming unit comprising the developer container of claim 1.

6. An image forming apparatus comprising the developer container of claim 1.

7. The developer container of claim 1, wherein for each developer chamber, the first opening and the second opening are formed on different sides of the body.

8. The developer container of claim 1, further comprising a shutter that closes or opens the first openings of the plurality of developer chambers.

9. A developer container comprising:

a body in which a plurality of developer chambers that store developer are arranged, each developer chamber having an opening; and a plurality of covers that seal the openings of the plurality of developer chambers, the plurality of covers being separately provided to correspond to the openings of the plurality of developer chambers, wherein the plurality of developer chambers include at least a first developer chamber and a second developer chamber that are arranged adjacent to each other; and the opening of the first developer chamber and the opening of the second developer chamber are formed on different sides of the body.

10. The developer container of claim 9, wherein the opening of the first developer chamber and the opening of the second developer chamber are formed on opposite sides of the body.

11. The developer container of claim 10, wherein each opening has an engaged portion;

each cover has a welding portion that engages with the engaged portion of the opening corresponding to the cover; and each welding portion is welded to the engaged portion corresponding to the welding portion so that each cover seals the opening corresponding to the cover.

12. The developer container of claim 11, wherein each welding portion is a projection having a substantially isosceles triangular cross-section.

13. The developer container of claim 9, wherein each opening has an engaged portion;

each cover has a welding portion that engages with the engaged portion of the opening corresponding to the cover; and each welding portion is welded to the engaged portion corresponding to the welding portion so that each cover seals the opening corresponding to the cover.

14. The developer container of claim 13, wherein each welding portion is a projection having a substantially isosceles triangular cross-section.

15. A developer container comprising:

a body in which a plurality of developer chambers that store developer are arranged, each developer chamber having an opening; and a plurality of covers that seal the openings of the plurality of developer chambers, the plurality of covers being separately provided to correspond to the openings of the plurality of developer chambers, wherein the openings have different shapes; and each cover has a shape corresponding to the shape of the opening corresponding to the cover.

* * * * *